US007058999B2

(12) United States Patent
Horitani et al.

(10) Patent No.: US 7,058,999 B2
(45) Date of Patent: Jun. 13, 2006

(54) ELECTRIC BED AND CONTROL APPARATUS AND CONTROL METHOD THEREFOR

(75) Inventors: Masao Horitani, Tokyo (JP); Hiroshi Nagaoka, Tokyo (JP); Satoru Inoue, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 0 days.

(21) Appl. No.: 10/689,647

(22) Filed: Oct. 22, 2003

(65) Prior Publication Data

US 2004/0133982 A1 Jul. 15, 2004

(30) Foreign Application Priority Data

Oct. 24, 2002 (JP) ..... 2002-310326
Nov. 11, 2002 (JP) ..... 2002-327627

(51) Int. Cl.
*A61G 7/015* (2006.01)
*A61G 7/018* (2006.01)

(52) U.S. Cl. ..... 5/618; 5/616

(58) Field of Classification Search ..... 5/616–618, 5/613, 600

See application file for complete search history.

(56) References Cited

U.S. PATENT DOCUMENTS 3,191,196 A * 6/1965 Holm ..... 5/616
3,237,212 A * 3/1966 Hillenbrand et al. ..... 5/616
3,398,411 A * 8/1968 Douglass ..... 5/618
3,840,911 A * 10/1974 Benoit et al. ..... 5/618
3,913,153 A 10/1975 Adams et al. ..... 5/616
4,097,940 A * 7/1978 Tekulve et al. ..... 5/616
4,385,410 A * 5/1983 Elliott et al. ..... 5/616
5,161,274 A * 11/1992 Hayes et al. ..... 5/618
5,377,369 A * 1/1995 Shirai ..... 5/236.1
5,377,373 A * 1/1995 Shirai ..... 5/613
5,388,290 A * 2/1995 Shirai ..... 5/236.1
5,448,789 A * 9/1995 Shirai ..... 5/613
6,000,076 A * 12/1999 Webster et al. ..... 5/618

(Continued)

FOREIGN PATENT DOCUMENTS

EP 0 498 111 A2 8/1992

(Continued)

OTHER PUBLICATIONS

European Search Report dated Jan. 23, 2004.

(Continued)

*Primary Examiner*—Robert G. Santos
(74) *Attorney, Agent, or Firm*—McGinn IP Law Group, PLLC

(57) ABSTRACT

In ($\alpha$, $\beta$) coordinates defined by a back angle $\alpha$ and a knee angle $\beta$, a pattern that connects between a coordinate point (0, 0) at which each of a back bottom and a knee bottom is horizontal and a coordinate point ($\alpha_0$, $\beta_0$) which is a final reaching point for a back lift-up operation and at which the back bottom is lifted up by a plurality of points is set, an optimal pattern which provides less slipperiness and less oppressive feeling is acquired beforehand, and a control section moves the back bottom and the knee bottom along the optimal pattern. This reliably prevents a carereceiver from slipping, regardless of subjective judgment by an operator or a carer, at the time of performing a back lift-up operation and back lift-down operation of an electric bed. It is therefore possible to prevent pressure from being applied onto the abdominal region and chest region of the carereceiver, thus relieving the carereceiver and carer of the burden.

53 Claims, 21 Drawing Sheets

U.S. PATENT DOCUMENTS

| | | | | |
|---|---|---|---|---|
| 6,226,816 | B1 * | 5/2001 | Webster et al. | 5/618 |
| 6,230,346 | B1 * | 5/2001 | Branson et al. | 5/618 |
| 6,351,861 | B1 * | 3/2002 | Shows et al. | 5/618 |
| 6,643,873 | B1 * | 11/2003 | Heimbrock et al. | 5/618 |
| 6,839,926 | B1 * | 1/2005 | Heimbrock et al. | 5/618 |
| 6,851,144 | B1 * | 2/2005 | Wang | 5/610 |
| 6,854,141 | B1 * | 2/2005 | Nagaoka et al. | 5/618 |
| 6,907,631 | B1 * | 6/2005 | Heaton | 5/618 |
| 6,957,458 | B1 | 10/2005 | Nagaoka et al. | 5/613 |
| 6,957,459 | B1 | 10/2005 | Nagaoka et al. | 5/618 |
| 6,957,460 | B1 | 10/2005 | Horitani | 5/618 |
| 2002/0078505 | A1 * | 6/2002 | Brooke et al. | 5/618 |
| 2004/0010851 | A1 * | 1/2004 | Nagaoka et al. | 5/618 |
| 2004/0055088 | A1 * | 3/2004 | Heimbrock et al. | 5/618 |
| 2004/0133982 | A1 * | 7/2004 | Horitani et al. | 5/618 |
| 2005/0076440 | A1 * | 4/2005 | Taguchi et al. | 5/618 |
| 2005/0229311 | A1 | 10/2005 | Brooke et al. | 005/618 |
| 2005/0273933 | A1 | 12/2005 | Nagaoka et al. | 005/613 |
| 2006/0000021 | A1 | 1/2006 | Hayes et al. | 005/618 |

FOREIGN PATENT DOCUMENTS

| | | |
|---|---|---|
| EP | 0 641 534 A2 | 3/1995 |
| EP | 0 787 475 A2 | 8/1997 |
| JP | 06-088218 | 3/1994 |
| JP | 09-308547 | 12/1997 |
| JP | 2001-37820 | 2/2001 |
| JP | 2001-327546 | 11/2001 |
| WO | WO 96/29970 | 10/1996 |

OTHER PUBLICATIONS

Japanese Office Action dated Mar. 8, 2005 with an English translation.

* cited by examiner $(\alpha, \beta) = (0, 0)$ $(\alpha, \beta) = (0, 25)$ $(\alpha, \beta) = (47, 15)$ $(\alpha, \beta) = (60, 15)$ $(\alpha, \beta) = (75, 0)$ $(\alpha, \beta) = (64, 10)$ $(\alpha, \beta) = (50, 10)$ $(\alpha, \beta) = (40, 25)$ $(\alpha, \beta) = (19, 25)$ $(\alpha, \beta) = (0, 10)$

ELECTRIC BED AND CONTROL APPARATUS AND CONTROL METHOD THEREFOR

BACKGROUND OF THE INVENTION

1. Field of the Invention

The present invention relates to an electric bed in nursing beds or the like, which can electrically lift up the back portion of the bed, and, more particularly, to an electric bed capable of lifting the back portion up without shifting a carereceiver, such as a patient, who is lying. or applying pressure on the carereceiver, and a control method and a control apparatus for the electric bed.

2. Description of the Related Art

In an aging society where the number of bedridden patients is increasing, it is necessary to set up the upper body of a patient on a bed for various purposes, such as a medical examination, eating a meal, watching a TV and reading a book. In this respect, electric beds which can electrically lift the back bottom and knee bottom of the bed up and down have been developed. However, back lift-up or back lift-down of an electric bed shifts the body of the patient or applies pressure on the patient. This results in the deviation between shift muscles and skins so that fine blood vessels extending from the muscles to the skins are stretched, thus making it likely to cause blocking of the blood vessels or interruption in the circulation of the blood. This damages the skins. It would put a significant burden on a caregiver or a carer to return the body of a bedridden patient, whose position has been shifted due to a back lift-up operation or back lift-down operation, to the original position because the patient cannot move himself or herself.

Further, at the time a patient on a bed who is not bedridden is moving on a wheelchair from the bed, lifting up the upper body of the patient on the bed makes it easier for the patient to take a sitting position on the bed, thus facilitating shifting of the patient onto the wheelchair. In this case, it is also desirable not to cause deviation on the body or apply pressure on the body at the time of lifting up the upper body of the patient.

There is a back/knee interlocked movement control method which is designed to solve the problems and makes an electric bed that ensures back lifting and knee lifting easier to use by changing the timing of an electrically powered back lift-up operation and knee lift-up operation or preventing the angle between the back bottom and the knee bottom from becoming unnecessarily narrower (as disclosed in Patent Document 1: Japanese Patent Laid-Open No. 2001-37820).

While the prior art described in the publication can independently control the back lift-up operation and knee lift-up operation, however, the back lift-up operation and knee lift-up operation are basically carried out separately. That is, an operator (caregiver) performs operations to start and stop back lifting and start and stop knee lifting. To prevent a patient from slipping by the back lifting, an operation to lift up the back bottom is performed after lifting the knee bottom up by 20 to 30°. While this prior art can achieve the original purpose, such an operation, if done by a carer, is a subjective operation of the carer, so that slipping of the patient's body at the time of lifting up the back of the patient cannot be prevented sufficiently. It is not also possible to surely prevent a patient from having an oppressive feeling in the back lift-up operation and back lift-down operation.

SUMMARY OF THE INVENTION

Accordingly, it is an object of the invention to provide an electric bed which can reliably prevent a carereceiver from slipping on the bed, regardless of subjective judgment by an operator or a carer, at the time of performing a back lift-up operation and back lift-down operation when the back bottom is lifted up (back lift-up operation) and when the back bottom is laid down (back lift-down operation) and can prevent pressure from being applied onto the abdominal region and chest region of the carereceiver, thus relieving the carereceiver and carer of the burden, and a control apparatus and control method for the electric bed.

An electric bed according to the invention comprises a back bottom; a knee bottom; a first drive section for rocking the back bottom up and down; a second drive section for rocking the knee bottom up and down; and a control section which controls the first drive section and the second drive section in such a way that a back angle $\alpha$ that is a lift-up angle of the back bottom from a horizontal state and a knee angle $\beta$ that is a lift-up angle of the knee bottom from a horizontal state change along a preset pattern, and which has a storage section for storing a pattern connecting between a coordinate point (0, 0) at which each of the back bottom and the knee bottom is horizontal and a coordinate point $(\alpha_0, \beta_0)$ at which the back bottom is lifted up in $(\alpha, \beta)$ coordinates by a plurality of points and an operation section for controlling the first drive section and the second drive section in such a way that the back angle $\alpha$ and the knee angle $\beta$ change along the pattern.

A control method according to the invention for an electric bed comprising a back bottom, a knee-bottom, a first drive section for rocking the back bottom up and down and a second drive section for rocking the knee bottom up and down comprises the steps of presetting, in a control section, a pattern connecting between a coordinate point (0, 0) at which each of the back bottom and the knee bottom is horizontal and a coordinate point $(\alpha_0, \beta_0)$ at which the back bottom is lifted up in $(\alpha, \beta)$ coordinates by a plurality of points, the $(\alpha, \beta)$ coordinates being defined by a back angle $\alpha$ that is a lift-up angle of the back bottom from a horizontal state and a knee angle $\beta$ that is a lift-up angle of the knee bottom from a horizontal state change along a preset pattern; and driving the first drive section and the second drive section in such a way that the back angle $\alpha$ and the knee angle $\beta$ change along the pattern.

A control apparatus according to the invention for controlling an electric bed comprising a back bottom, a knee bottom, a first drive section for rocking the back bottom up and down and a second drive section for rocking the knee bottom up and down comprises a storage section for a pattern connecting between a coordinate point (0, 0) at which each of the back bottom and the knee bottom is horizontal and a coordinate point $(\alpha_0, \beta_0)$ at which the back bottom is lifted up in $(\alpha, \beta)$ coordinates by a plurality of points, the $(\alpha, \beta)$ coordinates being defined by a back angle $\alpha$ that is a lift-up angle of the back bottom from a horizontal state and a knee angle $\beta$ that is a lift-up angle of the knee bottom from a horizontal state change along a preset pattern; and an operation section for controlling the first drive section and the second drive section in such a way that the back angle $\alpha$ and the knee angle $\beta$ change along the pattern.

Another electric bed according to the invention comprises a back bottom; a knee bottom; a first drive section for rocking the back bottom up and down; a second drive section for rocking the knee bottom up and down; and a control section which controls the first drive section and the second drive section in such a way that a back angle α that is a lift-up angle of the back bottom from a horizontal state and a knee angle β that is a lift-up angle of the knee bottom from a horizontal state change along a preset pattern, and which has a storage section for segmenting (α, β) coordinates into a plurality of areas by taking, as a reference, a pattern connecting between a coordinate point (0, 0) at which each of the back bottom and the knee bottom is horizontal and a coordinate point ($\alpha_0$, $\beta_0$) at which the back bottom is lifted up in the (α, β) coordinates by a plurality of points and storing operational modes of the back bottom and the knee bottom for each area, and an operation section for determining in which one of the areas the back bottom and the knee bottom are located and controlling the first drive section and the second drive section based on the operational modes of that determined area.

Another control method according to the invention for an electric bed comprising a back bottom, a knee bottom, a first drive section for rocking the back bottom up and down and a second drive section for rocking the knee bottom up and down comprises the steps of segmenting (α, β) coordinates, defined by a back angle α that is a lift-up angle of the back bottom from a horizontal state and a knee angle β that is a lift-up angle of the knee bottom from a horizontal state change along a preset pattern, into a plurality of areas by taking, as a reference, a pattern connecting between a coordinate point (0, 0) at which each of the back bottom and the knee bottom is horizontal and a coordinate point ($\alpha_0$, $\beta_0$) at which the back bottom is lifted up in the (α, β) coordinates by a plurality of points; presetting operational modes of the back bottom and the knee bottom in a control section for each area; determining in which one of the areas the back bottom and the knee bottom are located; and controlling the first drive section and the second drive section based on the operational modes of that determined area.

Another control apparatus according to the invention for controlling an electric bed comprising a back bottom, a knee bottom, a first drive section for rocking the back bottom up and down and a second drive section for rocking the knee bottom up and down comprises a storage section for segmenting (α, β) coordinates, defined by a back angle α that is a lift-up angle of the back bottom from a horizontal state and a knee angle β that is a lift-up angle of the knee bottom from a horizontal state change along a preset pattern, into a plurality of areas by taking, as a reference, a pattern connecting between a coordinate point (0, 0) at which each of the back bottom and the knee bottom is horizontal and a coordinate point ($\alpha_0$, $\beta_0$) at which the back bottom is lifted up in the (α, β) coordinates by a plurality of points, and storing operational modes of the back bottom and the knee bottom in a control section for each area; and an operation section for determining in which one of the areas the back bottom and the knee bottom are located, and controlling the first drive section and the second drive section based on the operational modes of that determined area.

DETAILED DESCRIPTION OF THE PREFERRED EMBODIMENTS

Preferred embodiments of the invention will now be described with reference to the accompanying drawings.

Figure 1:
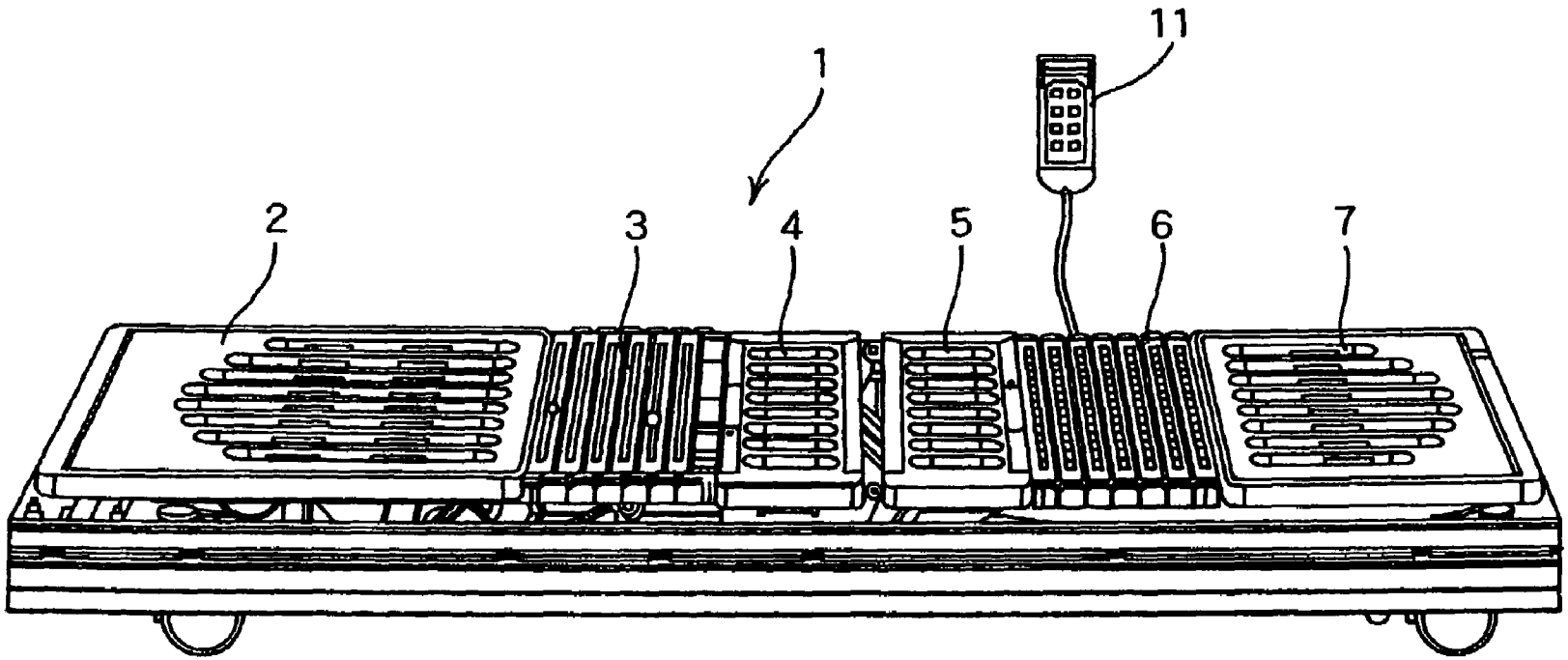
FIG. 1 is a perspective view showing an electric bed according to one embodiment of the invention.
Figure 2:
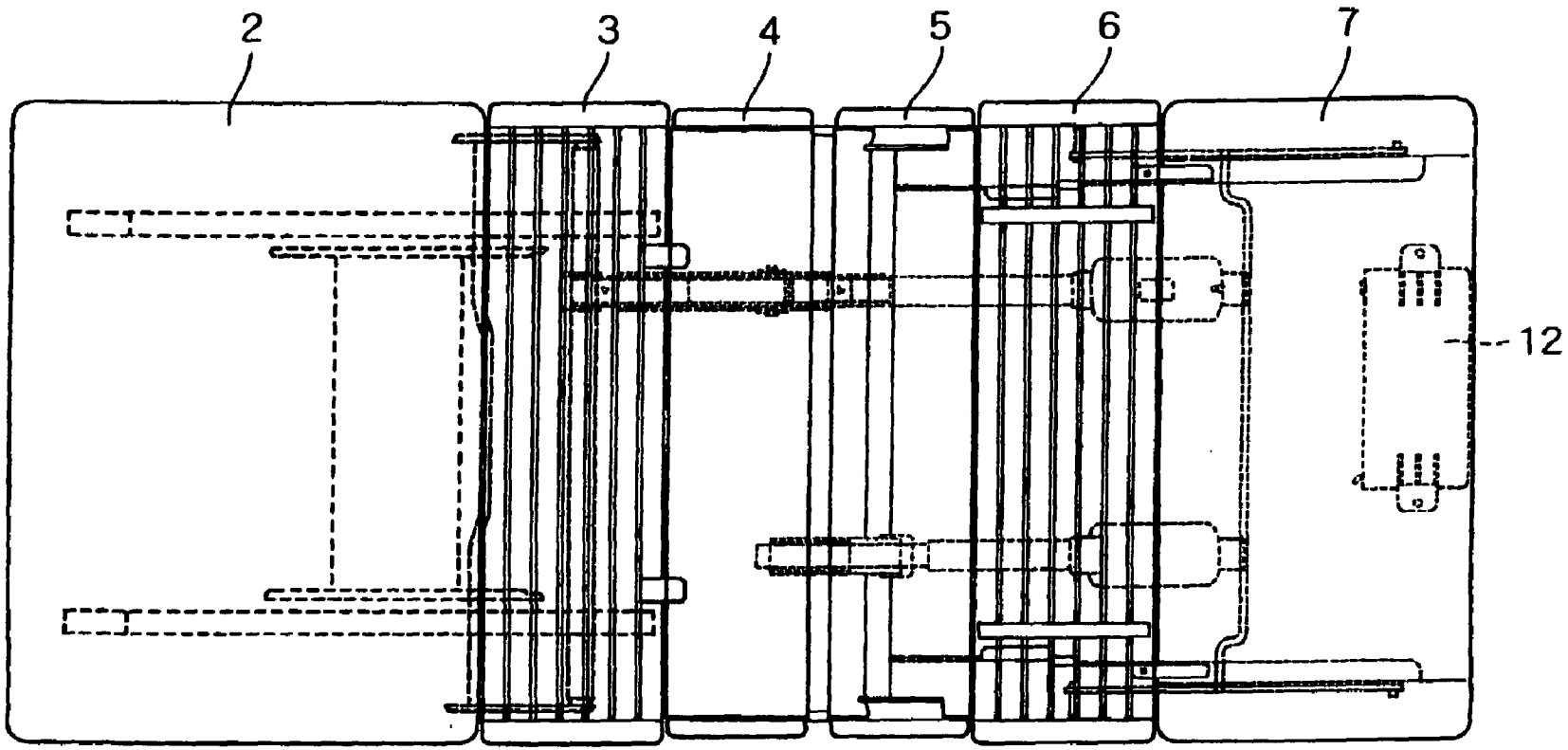
FIG. 2 is a plan view showing the back bottom, knee bottom and foot bottom of the electric bed and bending portions located among the bottoms.
Figure 3:
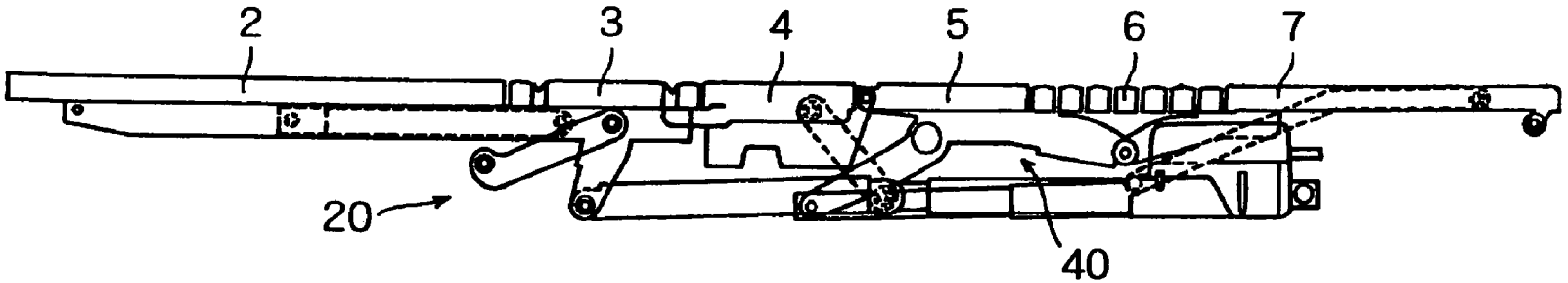
FIG. 3 is a front view of the bottoms and the bending portions.
Figure 4:
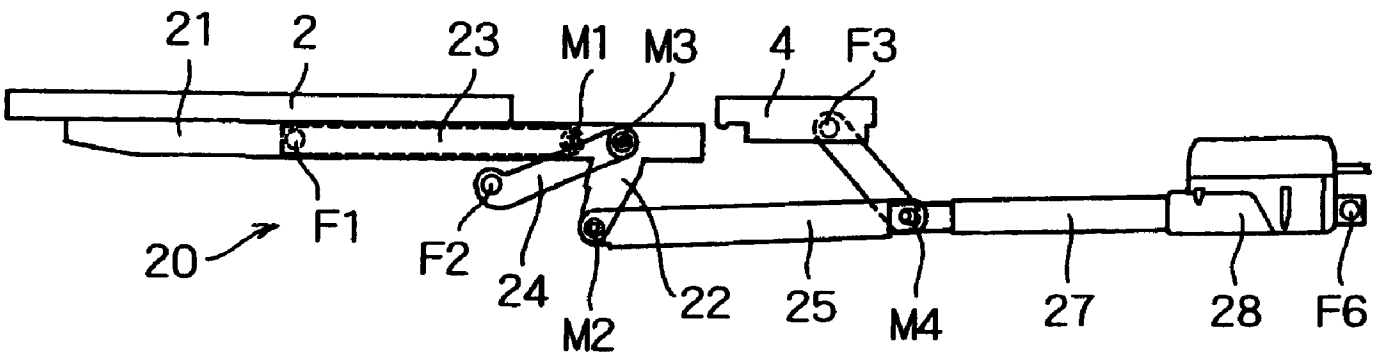
FIG. 4 is a front view of a back lift-up unit when the back bottom is horizontal.
Figure 5:
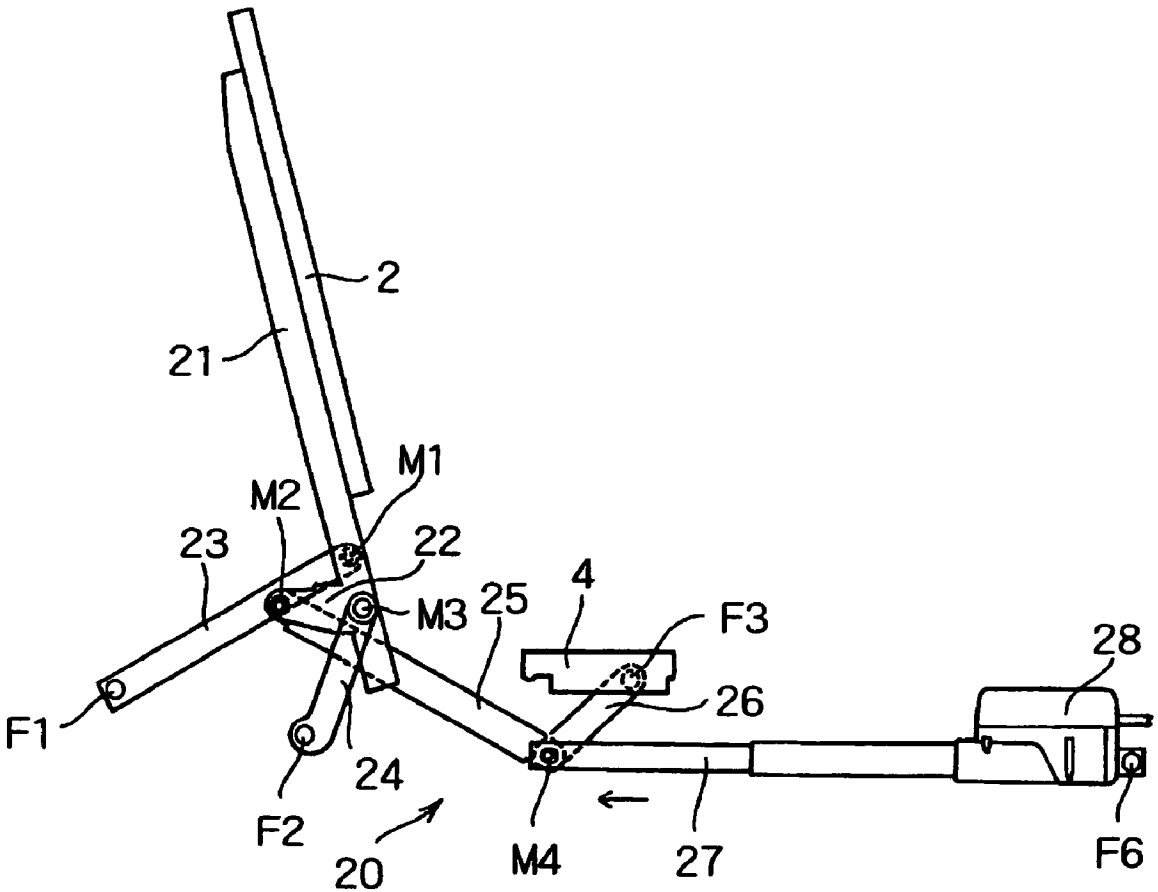
FIG. 5 is a front view of the back lift-up unit when the back bottom is lifted up.
Figure 6:
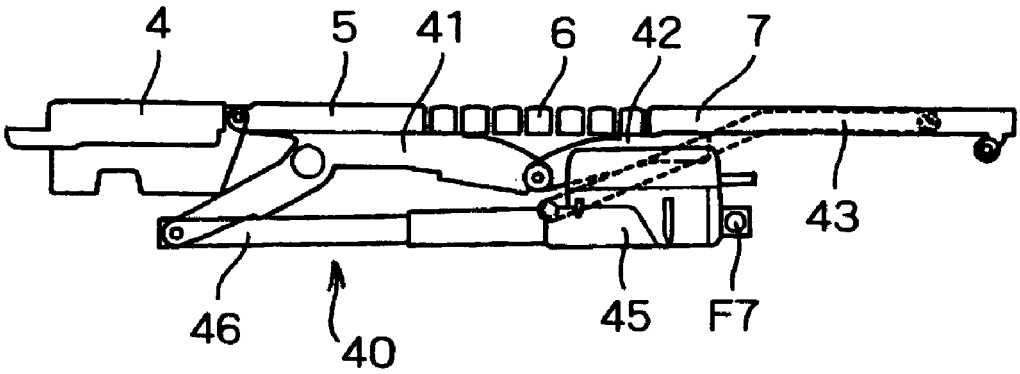
FIG. 6 is a front view of a knee lift-up unit when the knee bottom is horizontal.
Figure 7:
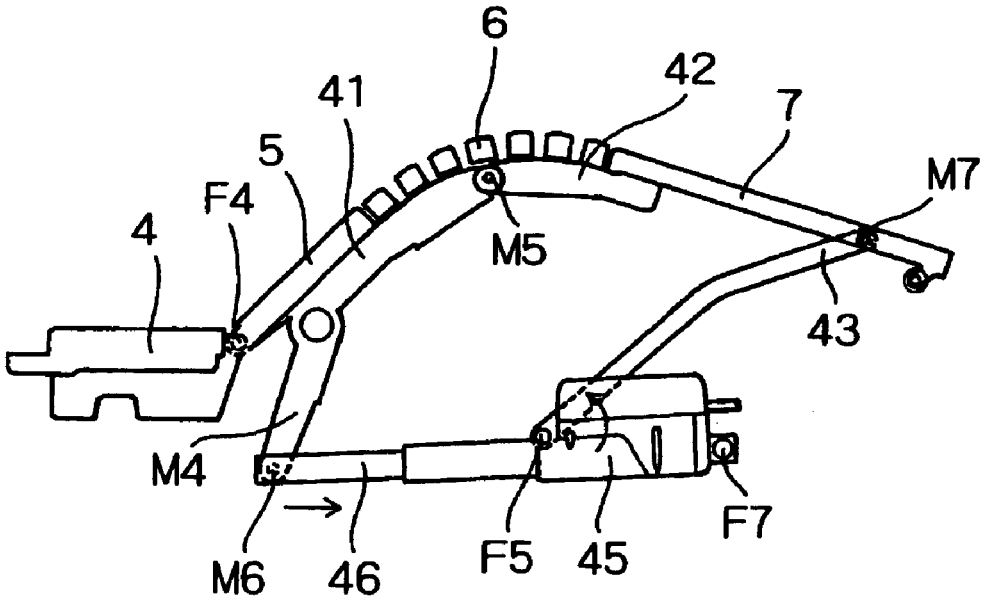
FIG. 7 is a front view of the knee lift-up unit when the knee bottom is lifted up.

FIG. 1 is a perspective view showing an electric bed according to one embodiment of the invention, FIG. 2 is a plan view showing the back bottom, knee bottom and foot bottom of the electric bed and bending portions located among the bottoms, FIG. 3 is a front view of the bottoms and the bending portions, FIG. 4 is a front View of a back lift-up unit when the back bottom is horizontal, FIG. 5 is a front view of the back lift-up unit when the back bottom is lifted up, FIG. 6 is a front view of a knee lift-up unit when the knee bottom is horizontal, FIG. 7 is a front view of the knee lift-up unit when the knee bottom is lifted up, and FIGS. 8 through 18 are perspective views illustrating the operation of the electric bed.

As shown in FIGS. 1 to 3, an electric bed 1 according to the embodiment has a back bottom 2, a back bending portion 3, a waist bottom 4, a knee bottom 5, a knee bending portion 6 and a foot bottom 7 coupled to one another in the named order. The back bottom 2 and the waist bottom 4 are coupled together by the back bending portion 3 which is bendable, and the knee bottom 5 and the foot bottom 7 are coupled together by the knee bending portion 6 which is also bendable. The waist bottom 4 is fixed. The back bottom 2 rotates in such a way that its head-side distal end is lifted up, rotates reversely in such a way as to return to a horizontal state, and rocks around the back bending portion 3. The knee bottom 5 rotates in such a way that its distal end on that side of the knee bending portion 6 is lifted up, rotates reversely in such a way as to return to a horizontal state, and rocks around the waist bottom 4. Each of the back bending portion 3 and the knee bending portion 6 is designed to have multiple bar members laid out in parallel to one another in the form of a reed screen and have the bar members coupled to one another in such a way that the gaps between the bar members are changeable. Each of the back bending portion 3 and the knee bending portion 6, as a whole, stretches and contracts in the coupling direction of the bar members and bends smoothly and continuously in the coupling direction of the bar members. An operation box 11 is provided with push buttons or switches to instruct a back lift-up operation and a back lift-down operation. Further, a control box 12 which retains a control apparatus which controls the operation of the electric bed 1 is located under the foot bottom 7, and a command signal from the operation box 11 is input to the control box 12.

The frames of the electric bed 1 which support the back bottom 2 and the other components is moved up and down by actuators (none shown) to be able to adjust the height of the bed 1.

As shown in FIGS. 2 and 3, provided below the back bottom 2, the back bending portion 3, the waist bottom 4, the knee bottom 5, the knee bending portion 6 and the foot bottom 7 are a back lift-up unit 20 which lifts the back bottom 2 up and a knee lift-up unit 40 which lifts the knee bottom 5 up.

As shown in FIGS. 4 and 5, in the back lift-up unit 20, a pair of parallel support bars 21 which extend in the lengthwise direction of the bed 1 are fixed to the bottom surface of the back bottom 2 to support the back bottom 2. A pair of parallel first links 23 which also extend in the lengthwise direction of the bed 1 are provided rotatable around a fixed support F1. The distal ends of the first links 23 are coupled to those portions of the support bars 21 which lie on that side of the waist bottom 4 by a moving support M1. Second links 24 are provided rotatable around a fixed support F2. The distal ends of the second links 24 coupled via a moving support M3 to those portions of the support bars 21 which are located closer to the waist bottom 4 than the moving support M1. Projections 22 which protrude downward are provided on the support bars 21 at positions on the waist bottom side. Third links 25 are coupled to the distal ends of the projection 22 via a moving support M2. The third links 25 are coupled to a piston rod 27 of an actuator 28 for back lift-up via a moving support M4. Further, fourth links 26 are rotatably supported on the waist bottom 4 via a fixed support F3. The distal ends of the fourth links 26 coupled to the moving support M4 which is a coupling point between the third links 25 and the piston rod 27. The rear end of the actuator 28 is rotatably supported on a fixed support F6 to allow the protraction/retraction direction of the piston rod 27 to be shifted slightly from the horizontal state.

As shown in FIGS. 6 and 7, in the knee lift-up unit 40, a support section 41 is fixed to the bottom surface of the knee bottom 5 and a support section 42 is fixed to the bottom surface of the foot bottom 7. The knee bottom 5 and the waist bottom 4 are coupled rotatably together by a fixed support F4. As the waist bottom 4 is fixed, the knee bottom 5 rocks via a fixed support F5. The support section 41 extends toward the foot bottom 7 while the support section 42 extends toward the knee bottom 5. Those portions of the support section 41 and support section 42 which are close to each other are coupled together by a moving support M5 lying under the knee bending portion 6. With the knee bottom 5 and the foot bottom 7 in a horizontal state, the support section 41 and the support section 42 are set apart from the knee bending portion 6 as shown in FIG. 6. With the knee bottom 5 lifted up, as shown in FIG. 7, the support section 41 and the support section 42 are bent in such a way that their top edges draw arcs to support the knee bending portion 6, which is likewise bent, from below. Fifth links 43 are rotatably supported at the fixed support F5 and the distal end portion of the foot bottom 7 is coupled to the distal ends of the fifth links 43 via a moving support M7. A portion 44 of the support section 41 on the opposite side to the support section 42 extends toward the waist bottom 4, and the distal end of the portion 44 is coupled to a piston rod 46 of an actuator 45 via a moving support M6. The rear end of the actuator 45 is rotatably supported on a fixed support F7 to allow the protraction/retraction direction of the piston rod 46 to be shifted slightly from the horizontal state.

In this specification, a "fixed support" means that the position of a support does not move but is fixed and the link that is rotatably supported on the fixed support itself is rotatable with respect to the fixed support. The fixed support is fixed to the frame that supports the back bottom 2 or the like, so that in case where the entire frame is lifted up or down to change the height of the bed, the fixed support is lifted up or down accordingly. A "moving support" is a support which itself moves as the associated link rotates.

Each of the actuators 28 and 45 incorporates a motor which rotates forward or reversely to protract or retract the associated piston rod 27 or 46. The actuators 28 and 45 are controlled by the control apparatus (not shown in FIG. 2) in the control box 12. A signal which is output by the depression of a switch on the operation box 11 is input to the control apparatus in the control box 12 by a serial communication system.

Figure 19:
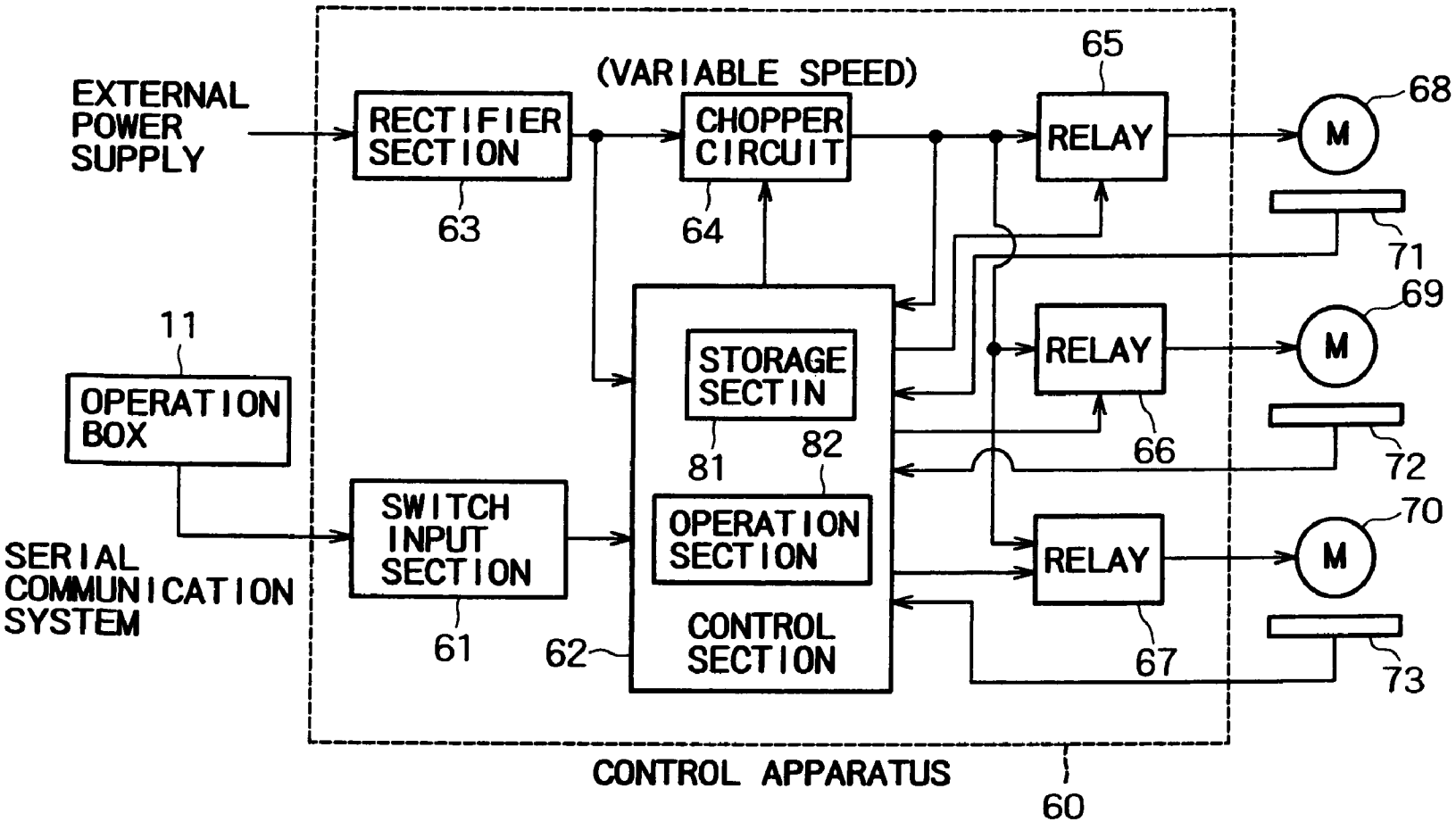
FIG. 19 is a block diagram showing a control apparatus according to one embodiment of the invention.

FIG. 19 is a block diagram showing the structure of this control apparatus 60. A switch ON/OFF signal coming from the operation box 11 is input to an input section 61 of the control apparatus 60, and then input to a control section 62. A power supply current is input to a rectifier section 63 to be converted to DC currents of 24 V and 5 V which are in turn supplied to a chopper circuit 64 and the control section 62. The control section 62 sends out a control signal for driving each actuator to the chopper circuit 64.

The chopper circuit 64 receives a signal undergone pulse width modulation (PWM) and controls motor currents. The chopper circuit 64 supplies the controlled motor currents to a motor 68 incorporated in the actuator (not shown) which adjusts the height of the bed, a built-in motor 69 of the actuator 28 of the back lift-up unit 20 and a built-in motor 70 of the actuator 45 of the knee lift-up unit 40 via a relay 65, a relay 66 and a relay 67, respectively. The outputs of the chopper circuit 64 are also input to the control section 62 so that the current signals are fed back to the control section 62. Control signals from the control section 62 are input to the relays 65, 66 and 67 to control the ON/OFF actions of the relays 65, 66 and 67. A detection signal from a sensor 71 which detects the position (protraction/retraction position) of the piston rod of the bed lift-up/down actuator, a detection signal from a sensor 72 which detects the position (protraction/retraction position) of the piston rod 27 of the actuator 28 of the back lift-up unit 20, and a detection signal from a sensor 73 which detects the position (protraction/retraction position) of the piston rod 46 of the actuator 45 of the knee lift-up unit 40 are input to the control section 62. The sensors 71 to 73 detect the positions of the associated piston rods. Schemes of detecting the position of the piston rod include, for example, the use of a potentiometer that measures the resistance which changes in accordance with the protraction/retraction of the piston rod, and a scheme of detecting the amount of the rotation of the motor or controlling the rotational speed of the motor to a predetermined value and multiplying the motor rotational speed by an operation time, thereby detecting the position of the piston rod. Sensors that detect the amount of the rotation of the motor include a sensor that measures the rotational angle or the number of rotations by light from a light-emitting diode which is blocked by or passes through a slit disk attached to a moving mechanism, such as a the rotary shaft of a motor, a sensor that magnetically detects the number of rotations by using a Hall element and a potentiometer that measures the resistance which changes in accordance with the rotation of a motor. Further, sensors that control the rotational speed of a motor include a sensor that controls power detects the counter electromotive force generated by the rotation of a motor, controls power based on the force to permit the motor to rotate at a constant speed and acquires the amount of the rotation of the motor by multiplying the rotational speed by the operation time, and a sensor that detects a voltage generated from a tachometer generator coupled to a motor, controls power in such a way as to permit the motor to rotate at a constant speed and acquires the amount of the rotation of the motor by multiplying the rotational speed by the operation time.

The control section 62 includes a storage section 81 and an operation section 82. Stored in the storage section 81 are reference patterns for back lift-up and back lift-down and operational modes. The pattern data may be stored in a ROM (Read Only Memory) or a RAM (Random Access Memory) beforehand so that the data can be updated externally.

Figure 20:
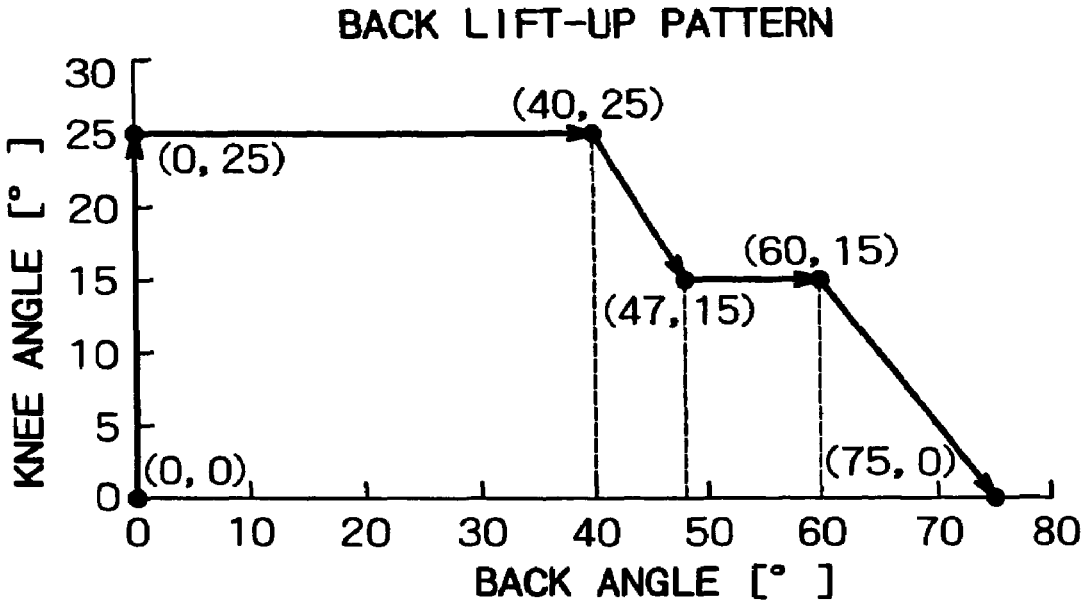
FIG. 20 is a graph showing a back lift-up pattern.
Figure 21:
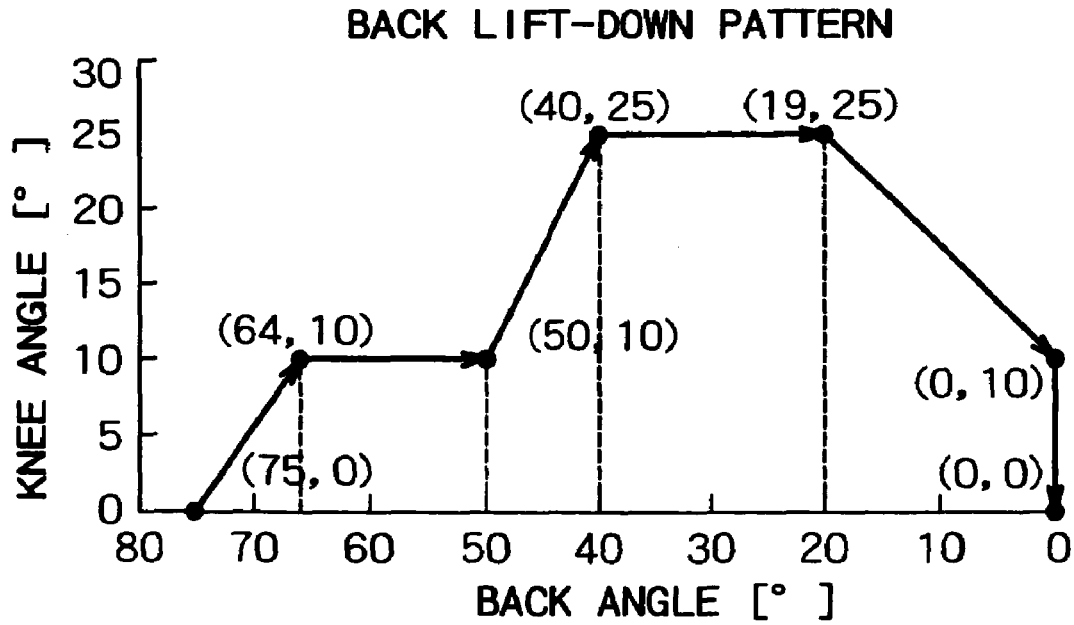
FIG. 21 is a graph showing a back lift-down pattern.

FIGS. 20 and 21 illustrate control patterns for back lift-up and back lift-down which are stored in the storage section 81. A back angle α is an angle of the back bottom 2 to the horizontal direction, and a knee angle β is an angle of the knee bottom 5 to the horizontal direction. The back angle α is geometrically calculated from the position of the piston rod 27 of the actuator 28 and the knee angle β is geometrically calculated from the position of the piston rod 46 of the actuator 45. Therefore, the relationships among the positions of those piston rods 27 and 46 of the actuators 28 and 45 and the back angle α and the knee angle β are acquired beforehand through geometrical calculation, are set in a correlation table and data on the correlation table is stored in the storage section 81. Then, the operation section 82 reads the back angle α and the knee angle β from the correlation table stored in the storage section 81 based on the results of detecting the positions of the piston rods 27 and 46 of the actuators 28 and 45 input from the respective sensors 72 and 73 and grasps the back angle α and knee angle β. Then, the operation section 82 compares the back angle α and the knee angle β with the pattern shown in FIG. 20 or FIG. 21, and outputs control signals to the relays 65, 66 and 67 in such a way that the results of measuring the back angle α and the knee angle β match with the pattern.

The control pattern is expressed by a coordinate system (α, β) defined by the back angle α and the knee angle β. That is, for the lift-up pattern that lifts up the back bottom 2, as shown in FIG. 20, the state where the back bottom 2 and the knee bottom 5 are horizontal is expressed by a coordinate point (0, 0) and in case where the back angle α of the back bottom 2 which should be reached finally is 75°, the final reaching point is expressed by a coordinate point (75, 0), four coordinate points (0, 25), (40, 25), (47, 15) and (60, 15) are set between the coordinate points (0, 0) and (75, 0) as one example, and a pattern is specified as straight lines that connect those coordinate points. For the lift-down pattern that lifts down the back bottom 2, on the other hand, as shown in FIG. 21, five coordinate points (64, 10), (50,10), (40, 25), (19, 25) and (0, 10) are set between the state where the back bottom 2 is lifted up to 75° (the knee bottom 5 is at 0°) and the coordinate point (0, 0) where the back bottom 2 is horizontal as one example, and a pattern is specified as straight lines that connect those coordinate points. Those back lift-up pattern and back lift-down pattern have been acquired beforehand in such a way as to minimize the slipping and pressure applied on a patient and are optimal patterns for the back lift-up operation and back lift-down operation.

A description will now be given of the operation of the thus constituted electric bed 1. First, the operations of the back lift-up unit 20 and the knee lift-up unit 40 will be discussed first. When the actuator 28 is actuated to protract the piston rod 27 from the horizontal state in FIG. 4 as shown in FIG. 5, because the fixed supports F1, F2 and F3 do not move, the fourth links 26 rotate clockwise and the third links 25 attempt to rotate the projections 22 of the support bars 21 of the back bottom 2 clockwise. As the first links 23 and the second links 24 that are rotatably supported at the fixed supports F1 and F2 are coupled to the support bars 21 at the moving supports M1 and M3, respectively, the cooperative working of the long first links 23 and the short second links 24 can allow the back bottom 2 to rotate up about the two points M1 and M3. When the piston rod 27 moves forward (protracts) by the actuation of the actuator 28, therefore, the third links 25 push the projections 22 of the support bars 21, causing the support bars 21 and the back bottom 2 to rotate clockwise about the two points. The back bottom 2 is set up as shown in FIG. 5 and the portion between the back bottom 2 and the fixed waist bottom 4 is bent smoothly by the back bending portion 3 (not shown in FIG. 5).

As the piston rod 27 of the actuator 28 is retracted, on the other hand, the third links 25 pull the projections 22 so that the support bars 21 and the back bottom 2 return to the horizontal state. As a result, the back bottom 2, the back bending portion 3 and the waist bottom 4 return to the horizontal state as shown in FIG. 4.

In the knee lift-up unit 40, as shown in FIG. 6, the piston rod 46 of the actuator 45 is protracted and the knee bottom 5, the knee bending portion 6 and the foot bottom 7 are horizontal. As the piston rod 46 of the actuator 45 is retracted, as shown in FIG. 7, the knee bottom 5 and the support section 41 rotate counterclockwise about the fixed support F4. Accordingly, the knee bottom 5 is lifted up. In this case, the knee bottom 5 is coupled to the foot bottom 7 via the support sections 41 and 42 and the foot bottom 7 is coupled to the fifth links 43 coupled to the fixed support F5. When the knee bottom 5 rises, therefore, the support section 42 is lifted up so that the foot bottom 7 whose rear portion is coupled to the fifth links 43 is moved upward while rotatably supported at the moving supports M5 and M7. At this time, the knee bending portion 6 connects between the knee bottom 5 and the foot bottom 7 and the lower portion of the knee bending portion 6 is supported by the support sections 41 and 42, so that the knee bending portion 6 is bent smoothly along the envelope of the upper edges of the support sections 41 and 42.

Such back lift-up operation and back lift-down operation progress interlockingly and simultaneously and the back bottom 2 and the knee bottom 5 move in the modes as shown in FIGS. 8 to 18 (the foot bottom 7 follows the knee bottom 5 too).

Figure 22:
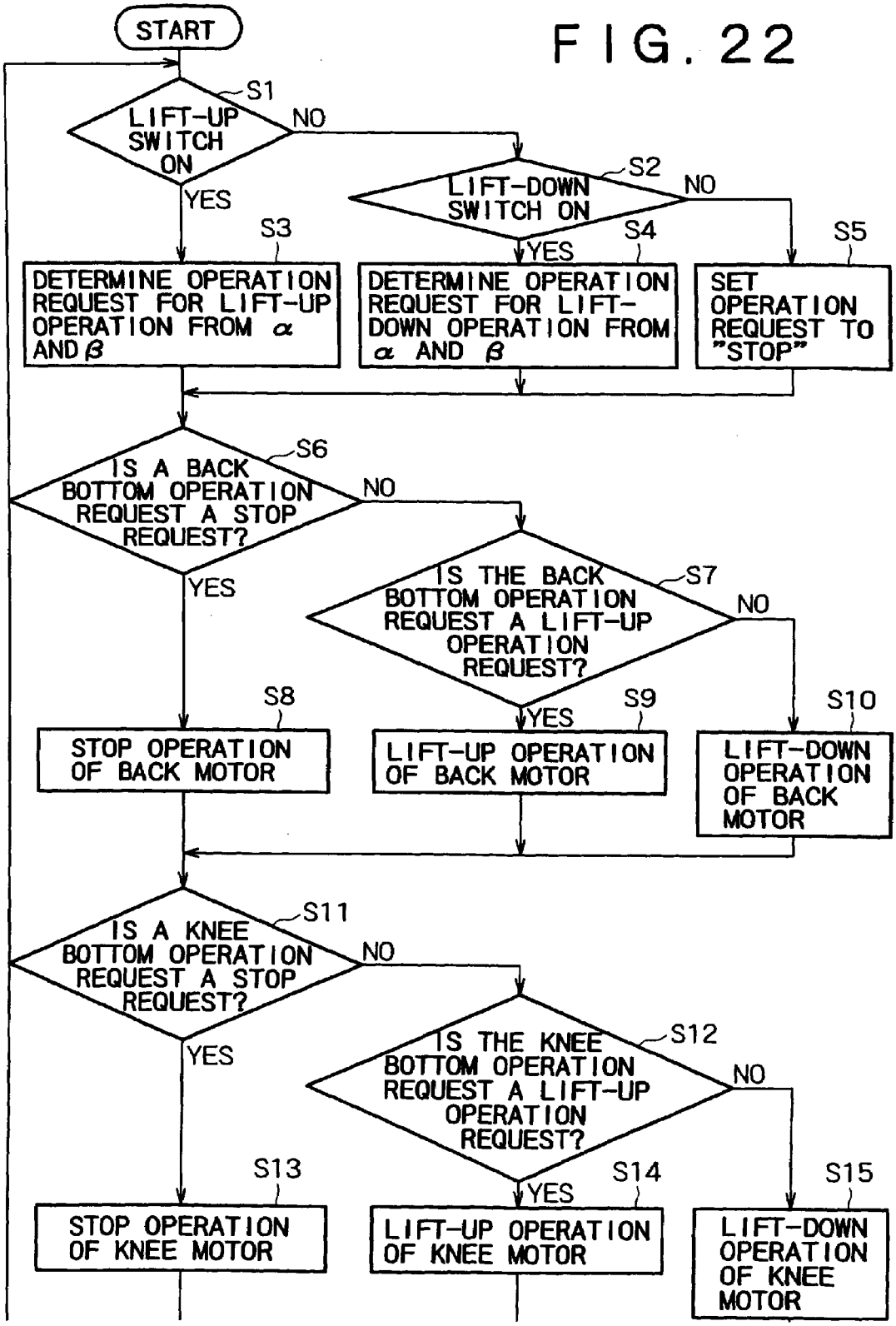
FIG. 22 is a flowchart for a control section.

The back lift-up unit 20 and knee lift-up unit 40 operate interlockingly in such a way that the back angle α and the knee angle β change along the patterns shown in FIGS. 20 and 21. FIG. 22 is a flowchart illustrating the operation of the control section 62 in FIG. 19.

In case where a signal instructing the initiation of the back lift-up operation (lift-up manipulation) is input to the control section 62 from the operation box 11, the decision in step Si in FIG. 22 is "YES", so that the operation section 82 of the control section 62 selects the lift-up pattern shown in FIG. 20 from the storage section 81. Then, the operation section 82 reads and grasps the back angle α of the back bottom 2 and the knee angle β of the knee bottom 5 using the correlation table stored in the storage section 81 based on the detection signals from the sensors 72 and 73 that are input to the control section 62.

Then, the operation section 82 compares the current back angle α and knee angle β with the lift-up pattern in FIG. 20 and decides an operation request for each of the actuators 28 and 47 (step S3). The operation request is a "stop request", "lift-up operation request" or "lift-down operation request" for the back bottom 2 or the knee bottom 5.

The operation section 82 compares the measured values of the back angle α and the knee angle β with the lift-up pattern. The operation section 82 outputs the "stop request" for the back bottom 2 when the back angle α matches with the angle indicated by the lift-up pattern, outputs the "lift-up operation request" for the back bottom 2 when the back angle α is smaller than the angle indicated by the lift-up pattern, and outputs the "lift-down operation request" for the back bottom 2 when the back angle α is greater than the angle indicated by the lift-up pattern. The same is true of the knee bottom 5. The operation section 82 outputs the "stop request" for the knee bottom 5 when the knee angle β matches with the angle indicated by the lift-up pattern, outputs the "lift-up operation request" for the knee bottom 5 when the knee angle β is smaller than the angle indicated by the lift-up pattern, and outputs the "lift-down operation request" for the knee bottom 5 when the knee angle β is greater than the angle indicated by the lift-up pattern.

In case where the start signal transferred from the operation box 11 indicates the initiation of the back lift-down operation (lift-down manipulation), the decision in step S1 in FIG. 22 is "NO", so that the flow proceeds to step S2. In this step S2, because of the start signal instructing the back lift-down operation, the decision is "YES" and the operation section 82 selects the lift-down pattern shown in FIG. 21 from the storage section 81. The operation section 82 grasps the back angle α and the knee angle β in the same manner as mentioned in the previous case, compares the back angle α and the knee angle β with the lift-down pattern in FIG. 21 and decides an operation request for each of the actuators 28 and 47 (step S4). The operation request is the "stop request", "lift-up operation request" or "lift-down operation request" for the back bottom 2 or the knee bottom 5.

The operation section 82 compares the measured values of the back angle α and the knee angle β with the lift-down pattern. The operation section 82 outputs the "stop request" for the back bottom 2 when the back angle α matches with the angle indicated by the lift-down pattern, outputs the "lift-up operation request" for the back bottom 2 when the back angle α is smaller than the angle indicated by the lift-down pattern, and outputs the "lift-down operation request" for the back bottom 2 when the back angle α is greater than the angle indicated by the lift-down pattern. The same is true of the knee bottom 5. The operation section 82 outputs the "stop request" for the knee bottom 5 when the knee angle β matches with the angle indicated by the lift-down pattern, outputs the "lift-up operation request" for the knee bottom 5 when the knee angle β is smaller than the angle indicated by the lift-down pattern, and outputs the "lift-down operation request" for the knee bottom 5 when the knee angle β is greater than the angle indicated by the lift-down pattern.

In case where the signal input to the control section 62 from the operation box 11 via the input section 61 indicates neither the initiation of the back lift-up operation nor the initiation of the back lift-down operation, the operation section 82 decides that the operation requests for both the back bottom 2 and the knee bottom 5 are the "stop request" (step S5).

In case where the operation request for the back bottom 2 is the "stop request" in step S6 in FIG. 22, the operation section 82 sends a control signal to the relay 66 of the actuator for the back bottom 2 to stop the motor 69 (step S8). In case where the operation request for the back bottom 2 is not the "stop request", the operation section 82 determines in step S7 whether or not the operation request for the back bottom 2 is the "lift-up operation request", and outputs a control signal to the relay 66 to rotate the motor 69 in the direction of increasing the back angle α of the back bottom 2 in case of the "lift-up operation request" ("YES") (step S9). In case of the "lift-down operation request" ("NO"), the operation section 82 outputs a control signal to the relay 66 to rotate the motor 69 in the direction of decreasing the back angle α of the back bottom 2 (step S10).

In case where the operation request for the knee bottom 5 is the "stop request" in step S11 in FIG. 22, the operation section 82 sends a control signal to the relay 67 of the actuator for the knee bottom 5 to stop the motor 70 (step S13). In case where the operation request for the knee bottom 5 is not the "stop request", the operation section 82 determines in step S12 whether or not the operation request for the knee bottom 5 is the "lift-up operation request", and outputs a control signal to the relay 67 to rotate the motor 70 in the direction of increasing the knee angle β of the knee bottom 5 in case of the "lift-up operation request" ("YES") (step S14). In case of the "lift-down operation request" ("NO"), the operation section 82 outputs a control signal to the relay 67 to rotate the motor 70 in the direction of decreasing the knee angle β of the knee bottom 5 (step S15).

Then, as the flow returns to step S1 again and is repeated at the adequate intervals, the back bottom 2 and the knee bottom 5 are lifted up or down along the pattern shown in FIG. 20 or FIG. 21. Because the flow returns to step S1 and step S2 after step S15 to determine whether the back lift-up switch is on or off and to determine whether the back lift-down switch is on or off, the lift-up operation takes place as long as the lift-up switch is always on or the lift-down operation takes place as long as the lift-down switch is always on. In case where the lift-up switch or the lift-down switch is switched off, the operation request always becomes "stop" in step S5 and all the operations stop. To continuously carry out the lift-up operation, therefore, the operator should normally set the lift-up switch on and should normally keep depressing the switch if it is of a push button type. In case where the lift-up switch and the lift-down switch are switched on simultaneously, the operation is normally stopped, though such is not illustrated in the flowchart in FIG. 22. Setting the switching actions in the above-described manner improves the safety.

Although the signal that instructs the initiation of the lift-up operation (lift-up manipulation) or the signal that instructs the initiation of the lift-down operation (lift-down manipulation) is input to the control section 62 of the control apparatus 60 from the operation box 11, such may be achieved by exclusively providing a push-button type of switch for starting the lift-up operation (first switch) and a push-button type of switch for starting the lift-down operation (second switch) on the operation box 11, or by providing a switch which selects a neutral position in the center, a lift-up operation and a lift-down operation as it is set to the center and set down to either the right or left position.

In this embodiment, the back angle α the back bottom 2 makes with respect to the horizontal direction and the knee angle β the knee bottom 5 makes with respect to the horizontal direction are geometrically calculated from the position of the piston rod 27 of the actuator 28 and the position of the piston rod 46 of the actuator 45, the relationships among the positions of those piston rods 27 and 46 and the back angle α and the knee angle β are expressed beforehand in the form of a correlation table, data on the correlation table is stored in the storage section 81, the operation section 82 reads the back angle α and the knee angle β from the correlation table stored in the storage section 81 based on the results of detecting the positions of the piston rods 27 and 46 of the actuators 28 and 45 input from the respective sensors 72 and 73, grasps the back angle α and knee angle β, compares the back angle α and the knee angle β with the pattern shown in FIG. 20 or FIG. 21 (stored in the storage section 81), and controls the driving of the back bottom 2 and the knee bottom 5 in such a way that the results of measuring the back angle α and the knee angle β match with the pattern.

However, the control on the driving of the back bottom 2 and the knee bottom 5 is not limited to this method, but the driving of the back bottom 2 and the knee bottom 5 may be controlled by directly controlling the actuators based on the results of detecting the positions of the pistons rods. Specifically, the positions (defined as "a") of the piston rod 27 of the actuator 28 for actuating the back bottom 2 when the back angle α becomes, for example, 0°, 40°, 47°, 60° and 75° in FIG. 20 may be acquired beforehand through geometric calculation, the positions (defined as "b") of the piston rod 46 of the actuator 45 for actuating the knee bottom 5 when the knee angle β becomes, for example, 0°, 25°, 15° and 0° in FIG. 20 may be acquired beforehand through geometric calculation, the optimal patterns in the (a, b) coordinates may be stored in the storage section 81, and the actuators may be driven in such a way that the positions of the individual piston rods 27 and 46 come to the positions designated by the (a, b) coordinates, when the positions of the piston rods 27 and 46 are detected by the sensors 72 and 73, through direct comparison of the detected positions of the piston rods 27 and 46 with the optimal patterns in the (a, b) coordinates. In this case, patterns in the (a, b) coordinates in terms of the positions of the piston rods are stored in the storage section 81 instead of the patterns of (α, β) defined by the back angle α and the knee angle β in FIGS. 20 and 21.

Alternatively, the height of the distal-end side position of the back bottom 2 when the back bottom 2 rotates and the height of the distal-end side position of the knee bottom 5 (the end portion on that side of the knee bending portion 6) when the knee bottom 5 rotates may be detected by photosensors or ultrasonic sensors or the like, and the driving of the back bottom 2 and the knee bottom 5 may be controlled along the patterns shown in FIGS. 20 and 21 based on the heights. In this case too, the height positions may be converted in terms of the back angle α and the knee angle β and the driving of the back bottom 2 and the knee bottom 5 may be controlled in such a way that the back angle α and the knee angle β change along the patterns shown in FIGS. 20 and 21. Optimal patterns with the height positions of the back bottom 2 and the knee bottom 5 taken as coordinate points may be prepared and the driving of the back bottom 2 and the knee bottom 5 may be controlled by directly comparing those optimal patterns with the results of detecting the height positions.

Figure 8:
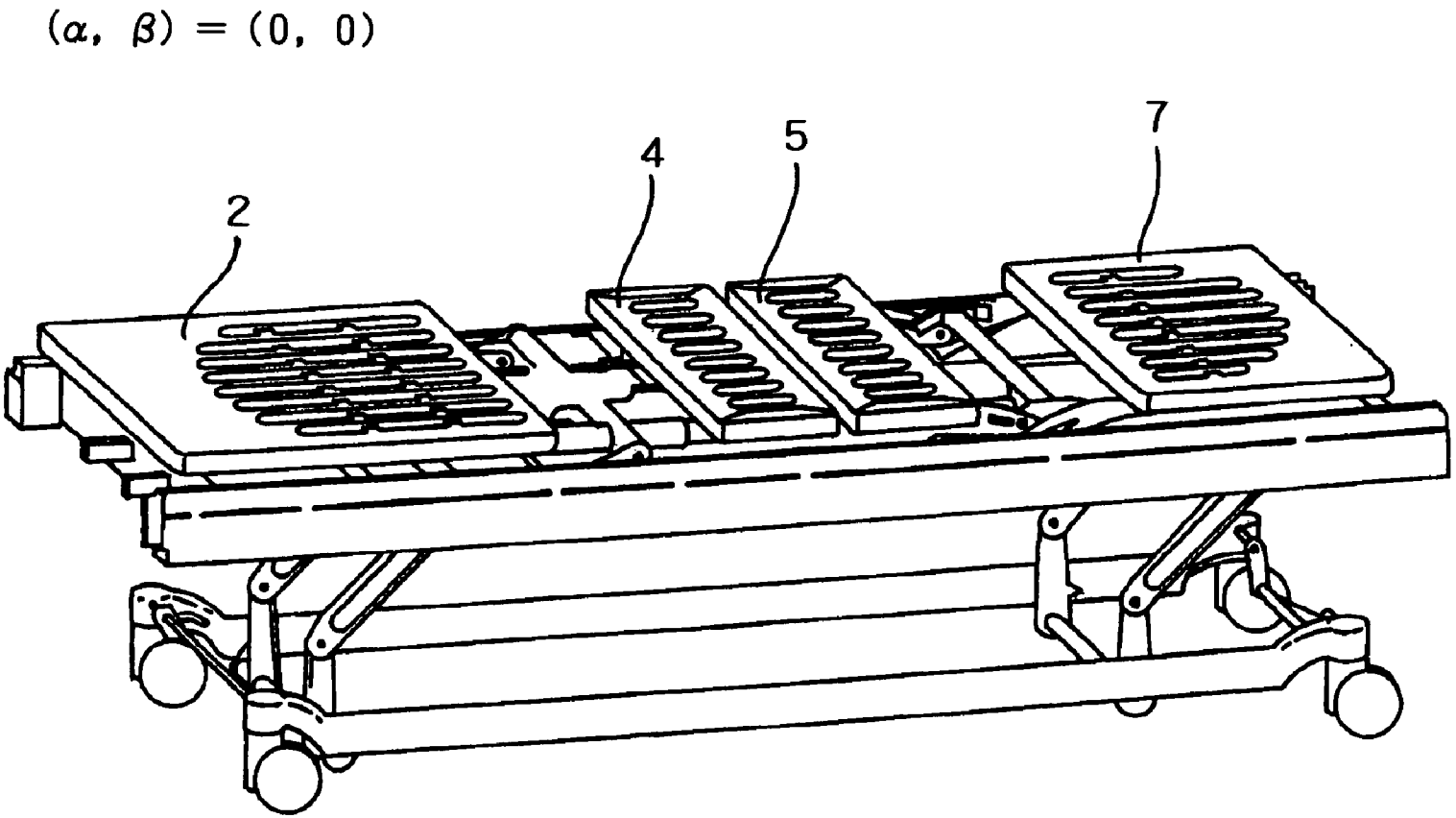
FIG. 8 is a perspective view illustrating the operation of the electric bed when coordinates (α, β) are (0, 0)
Figure 9:
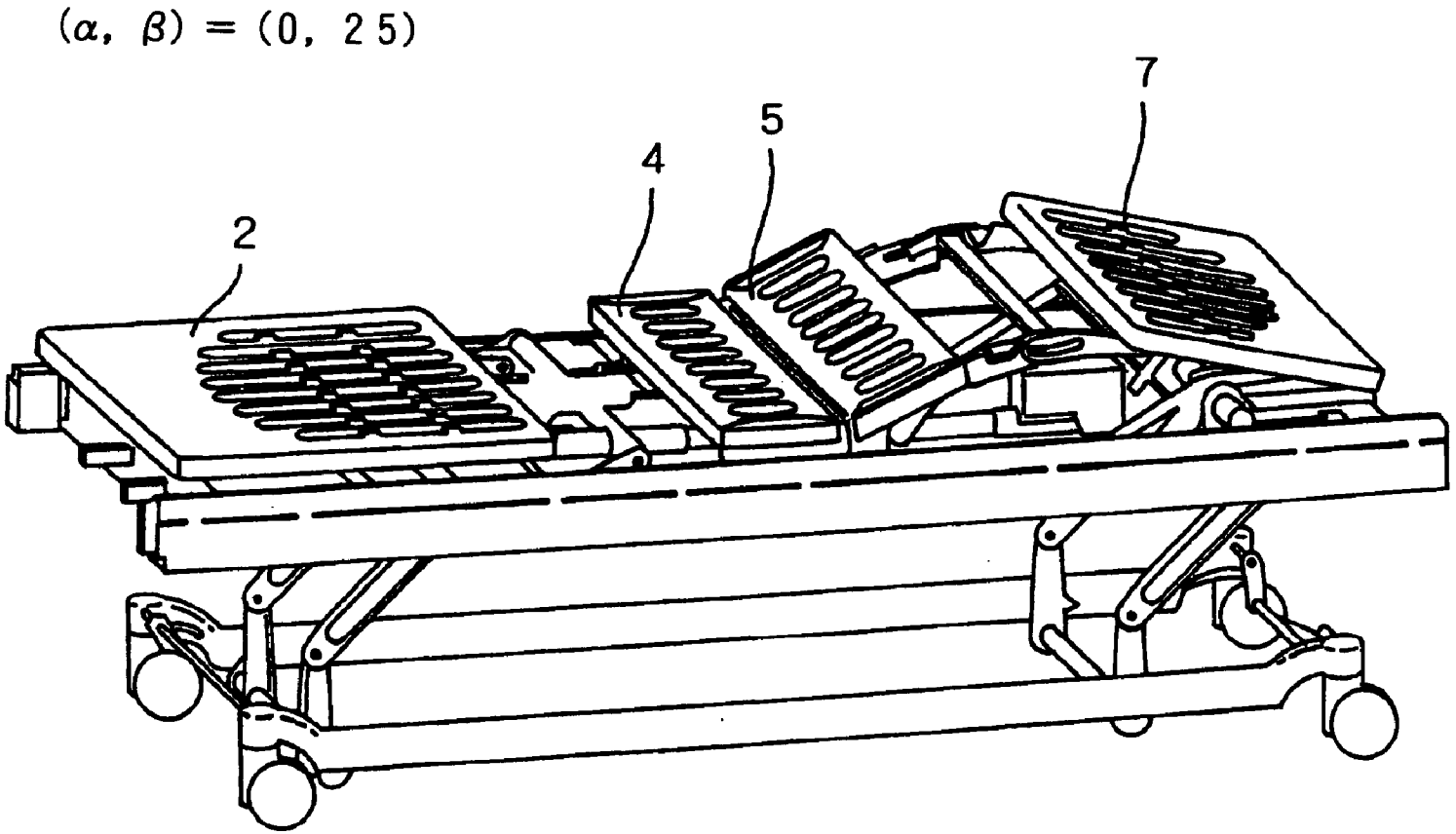
FIG. 9 is a perspective view illustrating the operation of the electric bed when the coordinates (α, β) are (0, 25)
Figure 10:
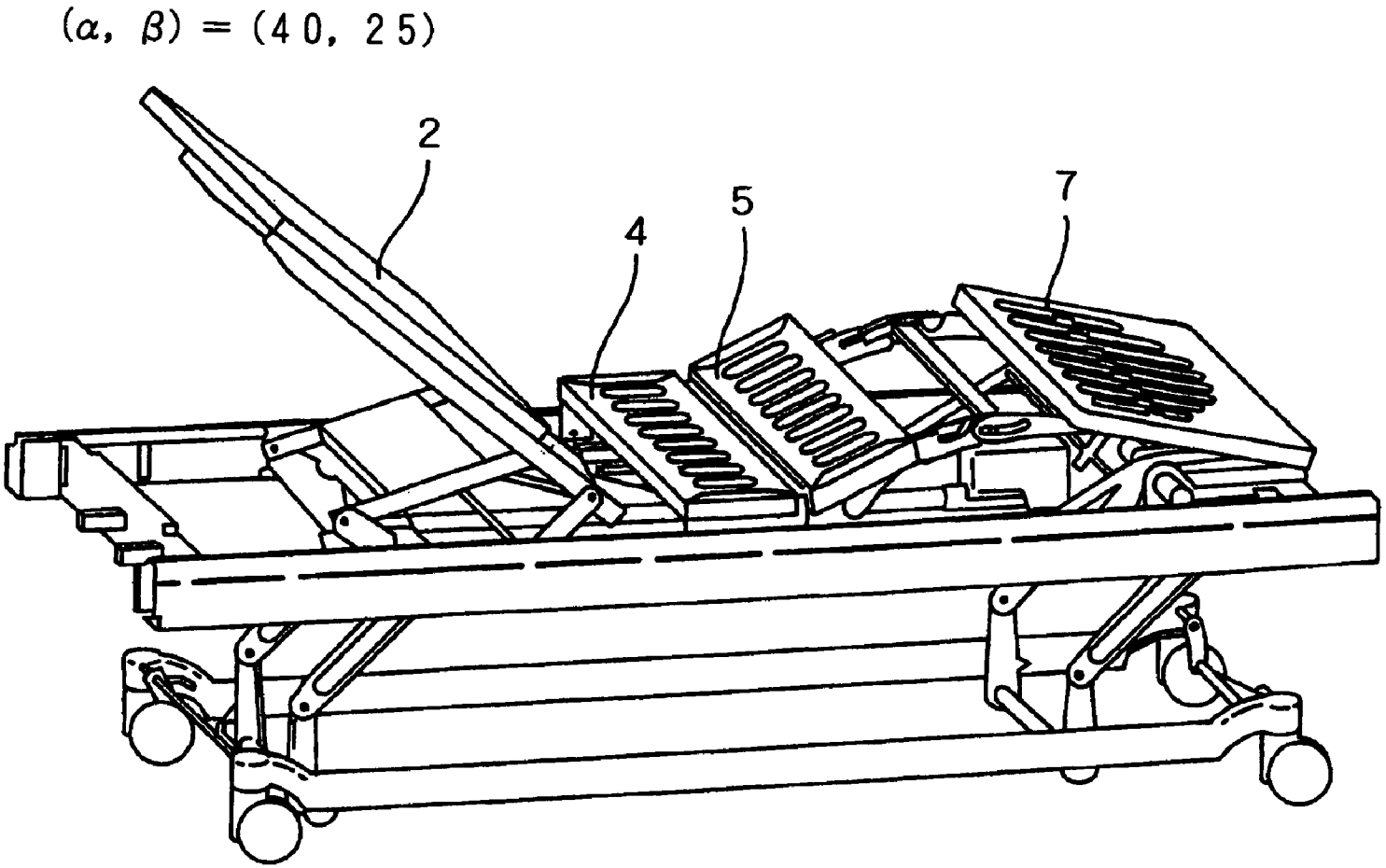
FIG. 10 is a perspective view illustrating the operation of the electric bed when the coordinates (α, β) are (40, 25)
Figure 11:
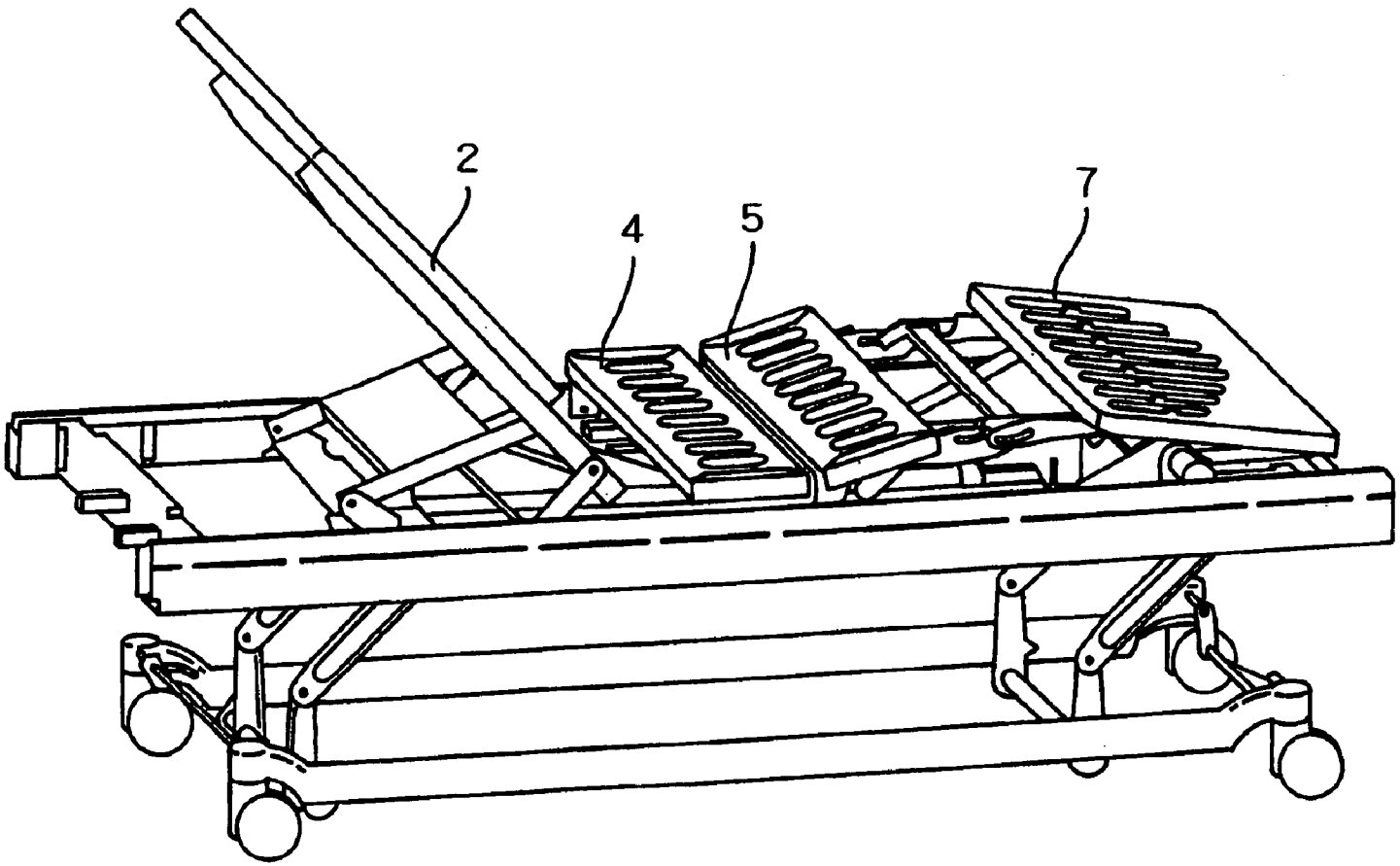
FIG. 11 is a perspective view illustrating the operation of the electric bed when the coordinates (α, β) are (47, 15)

A description will now be given of the modes in which the back bottom 2 and the knee bottom 5 perform the lift-up operation or lift-down operation along the pattern. FIGS. 8 to 13 illustrate changes in the bed in the case of the back lift-up operation. FIGS. 8 to 13 show only the back bottom 2, the waist bottom 4, the knee bottom 5 and the foot bottom 7 and do not show the other components, such as the knee bending portions. In the coordinates (0, 0) in FIG. 20, the bed is horizontal state as shown in FIG. 8. Next, the bed is shifted from the coordinates (0, 0) to the coordinates (0, 25). Consequently, the knee bottom 5 is lifted up with the back bottom 2 staying unchanged, as shown in FIG. 9. Then, the bed is shifted from the coordinates (0, 25) to the coordinates (40, 25). As a result, the back angle α increases to 40° with the knee angle β remaining constant (25°), as shown in FIG. 10. Thereafter, the bed is shifted from the coordinates (40, 25) to the coordinates (47, 15). That is, while the back angle α increases, the knee angle β decreases. As a result, the back bottom 2 and the knee bottom 5 are set in intermediate states, as shown in FIG. 11.

Figure 12:
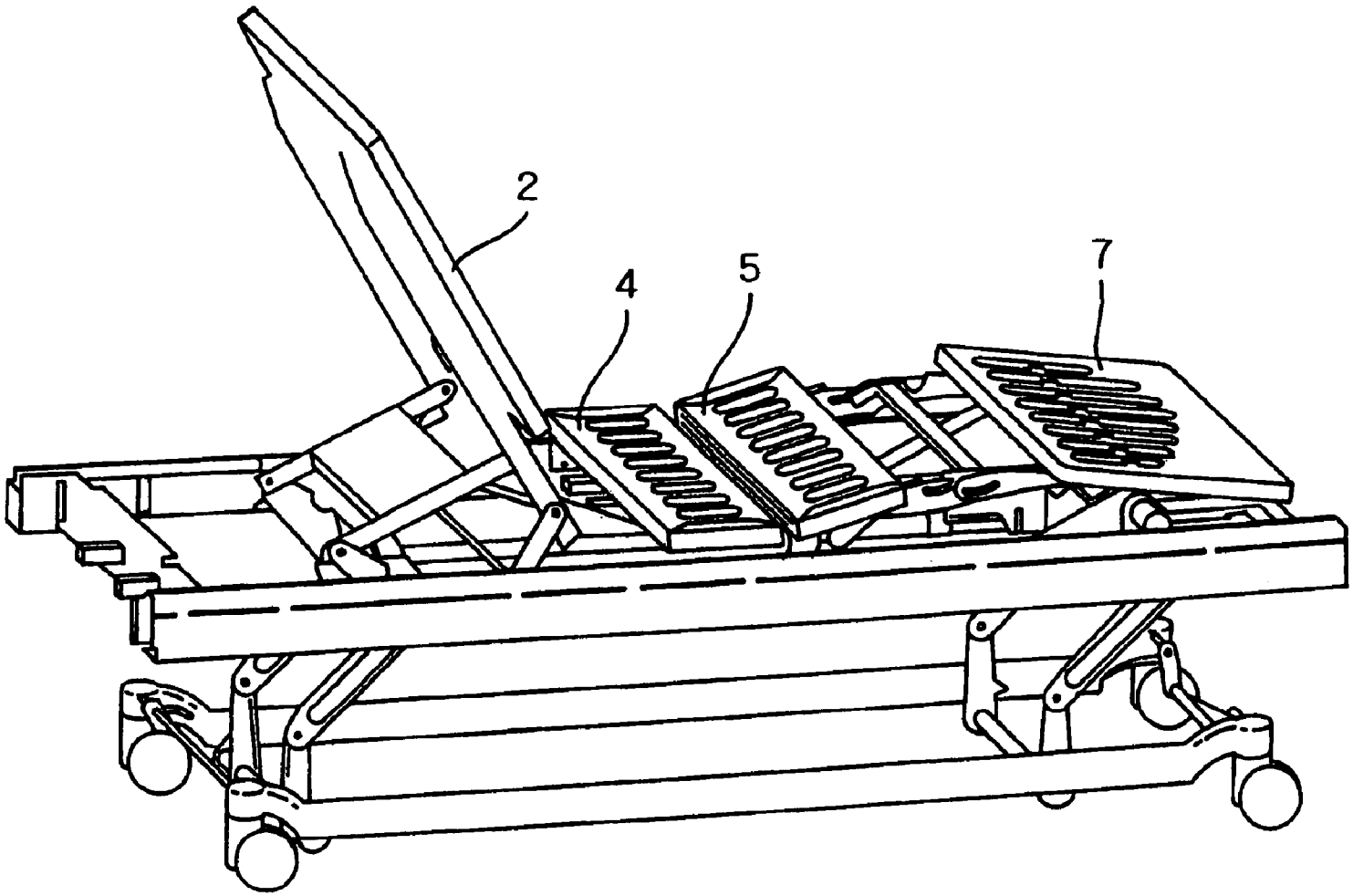
FIG. 12 is a perspective view illustrating the operation of the electric bed when the coordinates (α, β) are (60, 15)

Next, the bed is shifted from the coordinates (47, 15) to the coordinates (60, 15). That is, the back angle α is further increased with the knee angle β remaining constant. As a result, the bed comes to the state as shown in FIG. 12.

Thereafter, the bed is shifted from the coordinates (60, 15) to the coordinates (70, 0). That is, the knee angle β is decreased and the back angle α is further increased to the final target coordinates (75, 0), as shown in FIG. 13.

Figure 13:
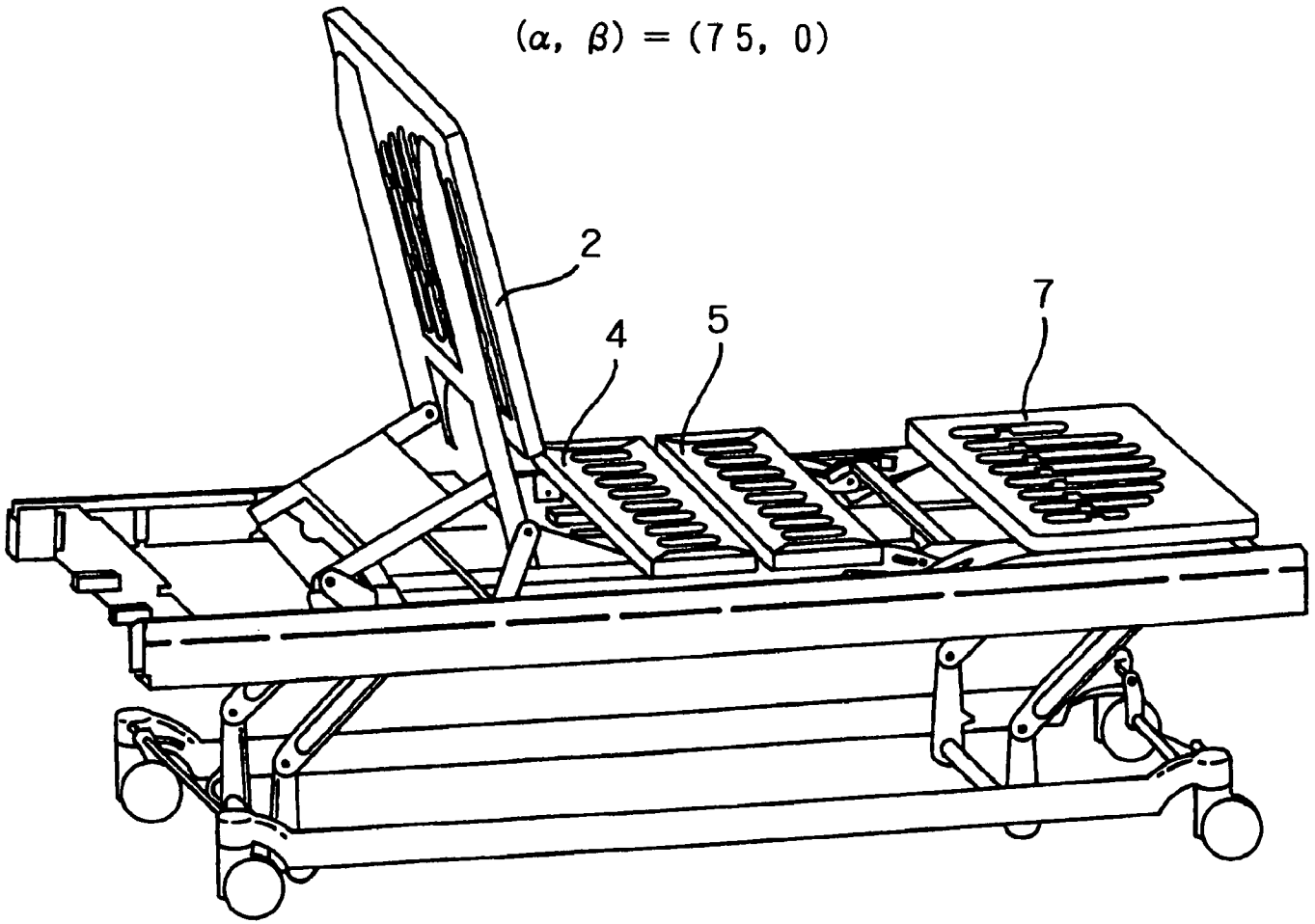
FIG. 13 is a perspective view illustrating the operation of the electric bed when the coordinates (α, β) are (75, 0)
Figure 14:
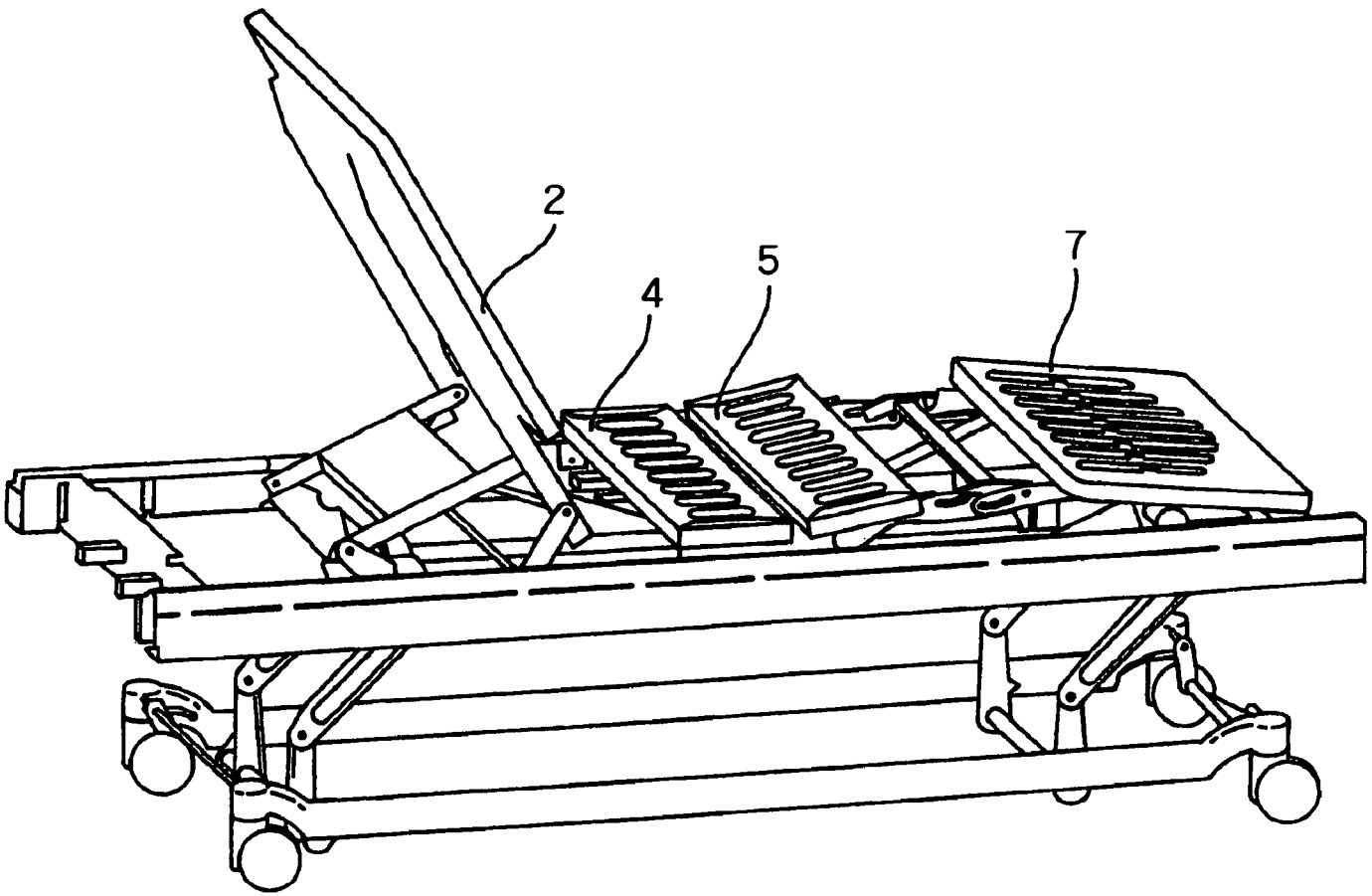
FIG. 14 is a perspective view illustrating the operation of the electric bed when the coordinates (α, β) are (64, 10)

The back bottom 2 is changed along such a pattern from the horizontal state shown in FIG. 8 to the state shown in FIG. 13 where the back bottom 2 is lifted up to 75°.

Figure 15:
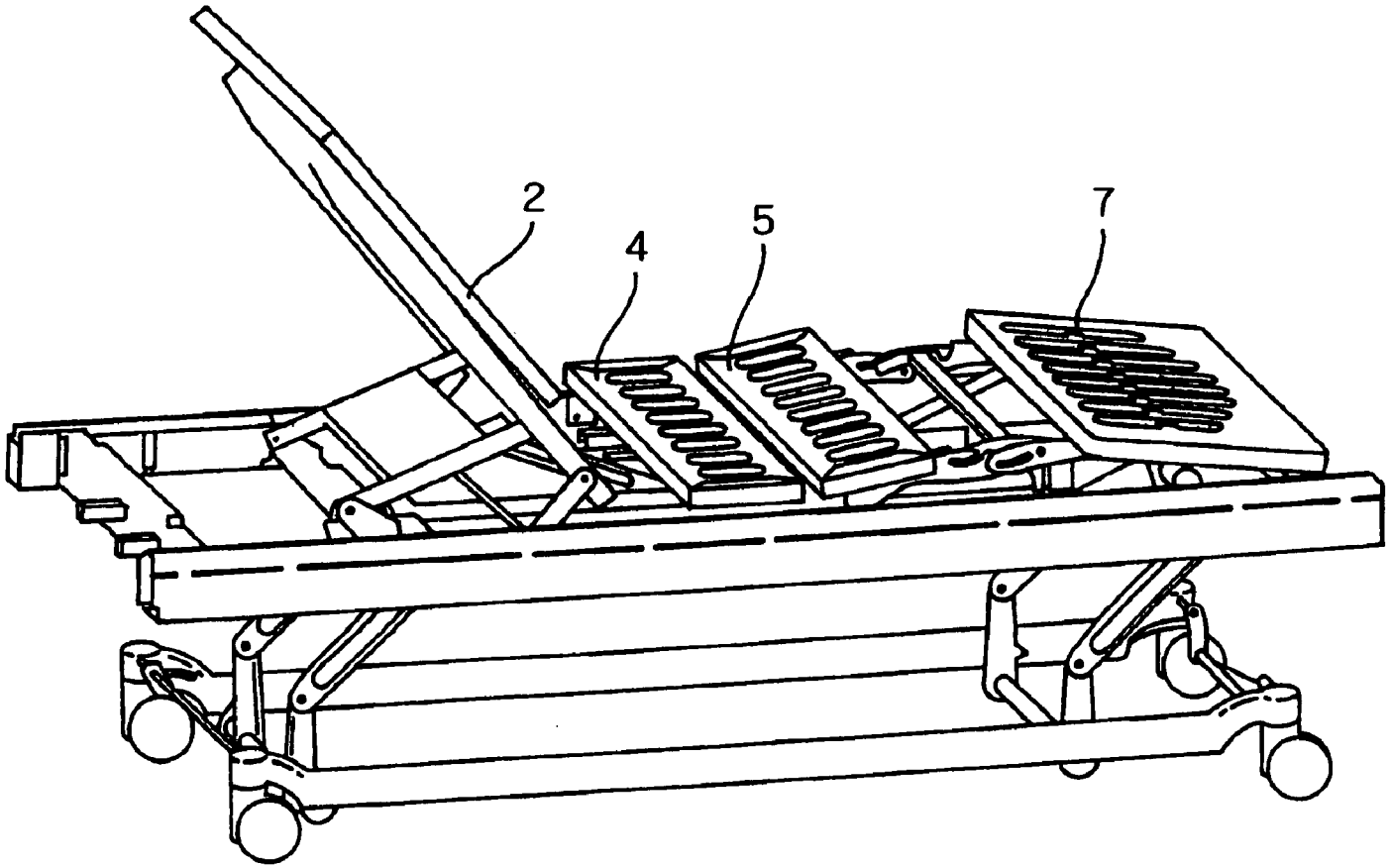
FIG. 15 is a perspective view illustrating the operation of the electric bed when the coordinates (α, β) are (50, 10)

In the lift-down operation of the back bottom 2, the shape of the bed is changed in the modes shown in FIGS. 13 to 18. That is, the bed is shifted from the coordinates (75, 0) shown in FIG. 21 to the coordinates (64, 10). Consequently, the knee bottom 5 is lifted up and the back bottom 2 is lifted down Next, the bed is shifted from the coordinates (64, 10) to the coordinates (50, 10). Consequently, only the back bottom 2 is lifted down with the position of the knee bottom 5 unchanged, as shown in FIG. 15.

Figure 16:
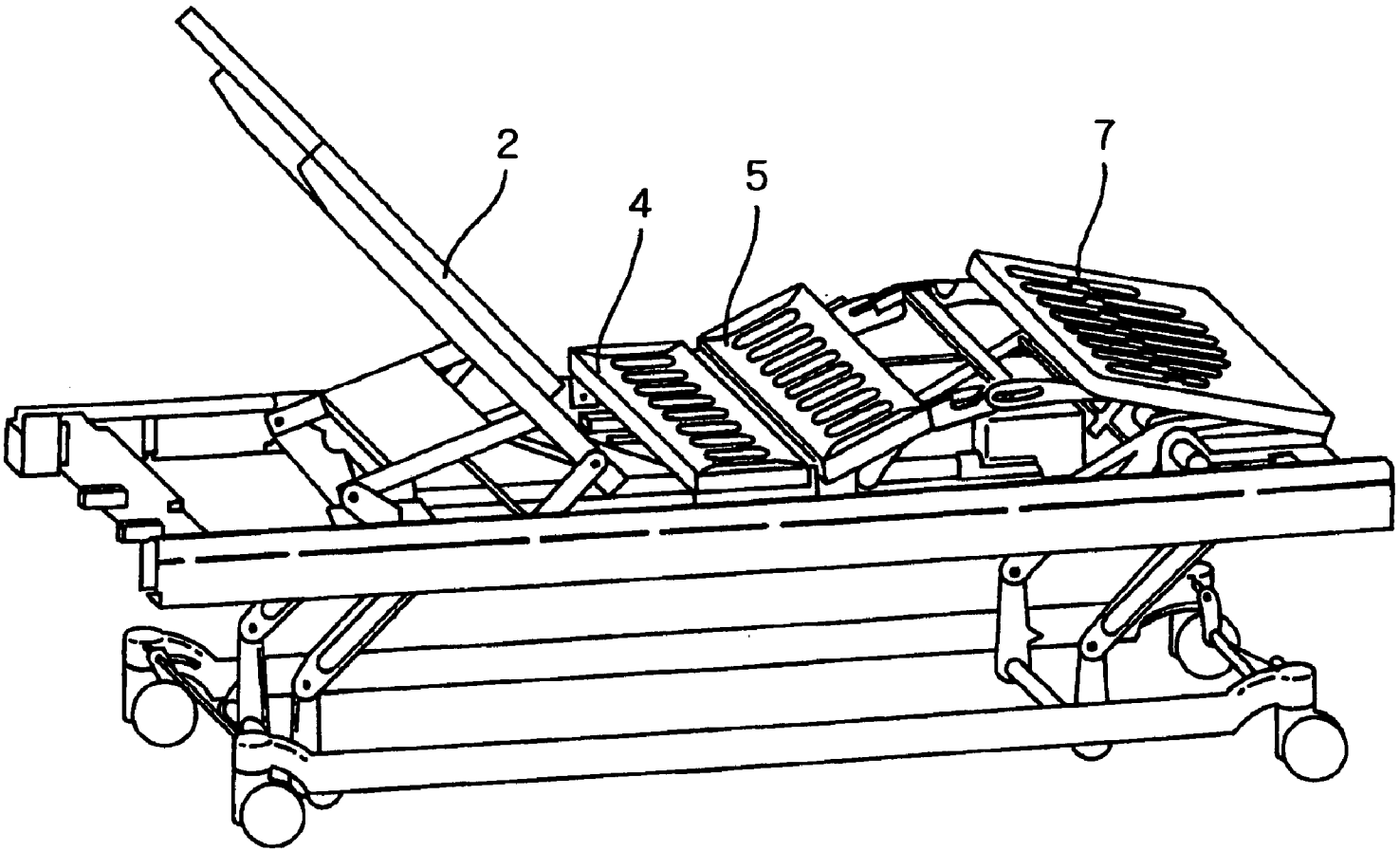
FIG. 16 is a perspective view illustrating the operation of the electric bed when the coordinates (α, β) are (40, 25)

Next, the bed is shifted from the coordinates (50, 10) to the coordinates (40, 25). As a, only the back bottom 2 is lifted further down and the knee bottom 5 is lifted up, as shown in FIG. 16.

Figure 17:
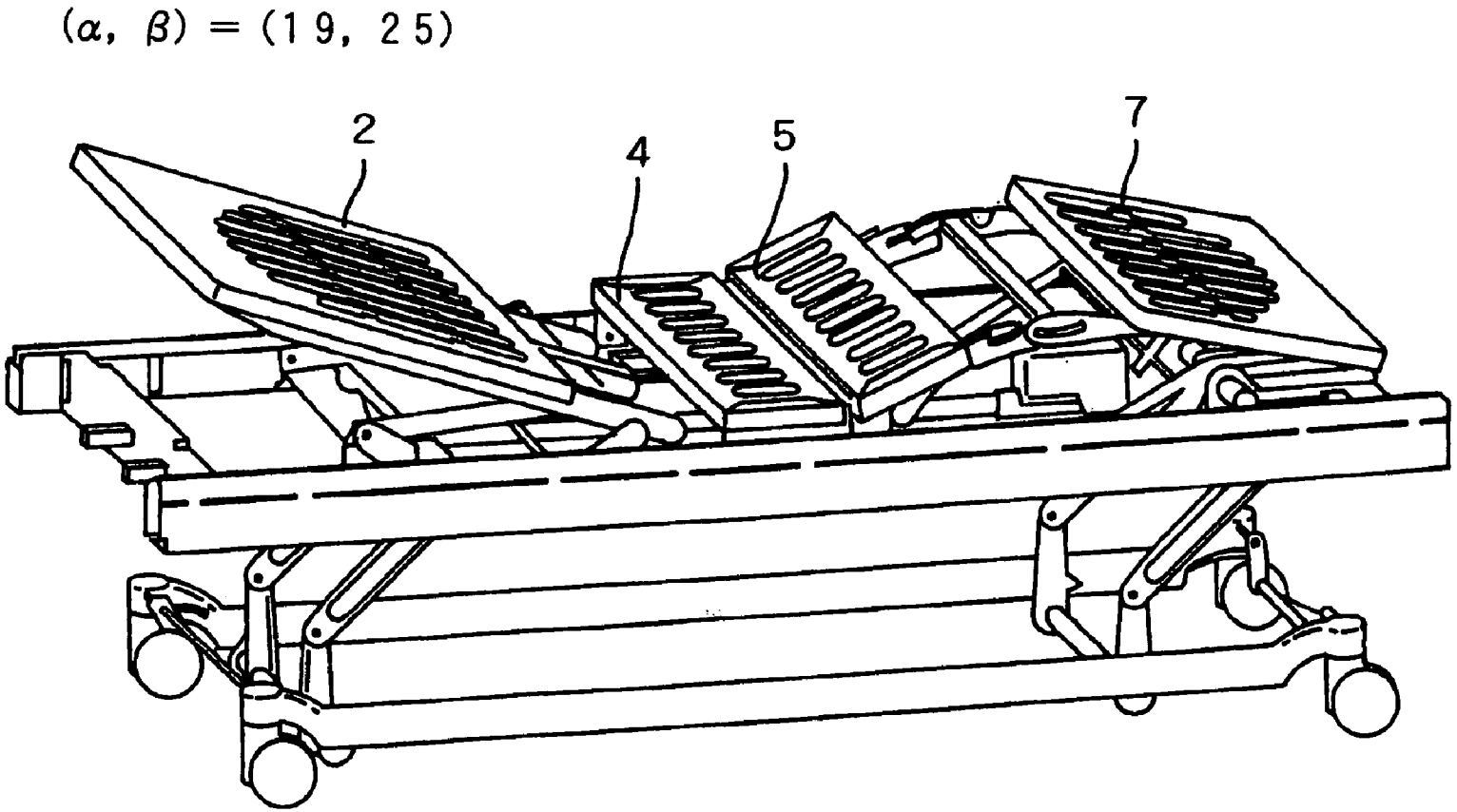
FIG. 17 is a perspective view illustrating the operation of the electric bed when the coordinates (α, β) are (19, 25)
Figure 18:
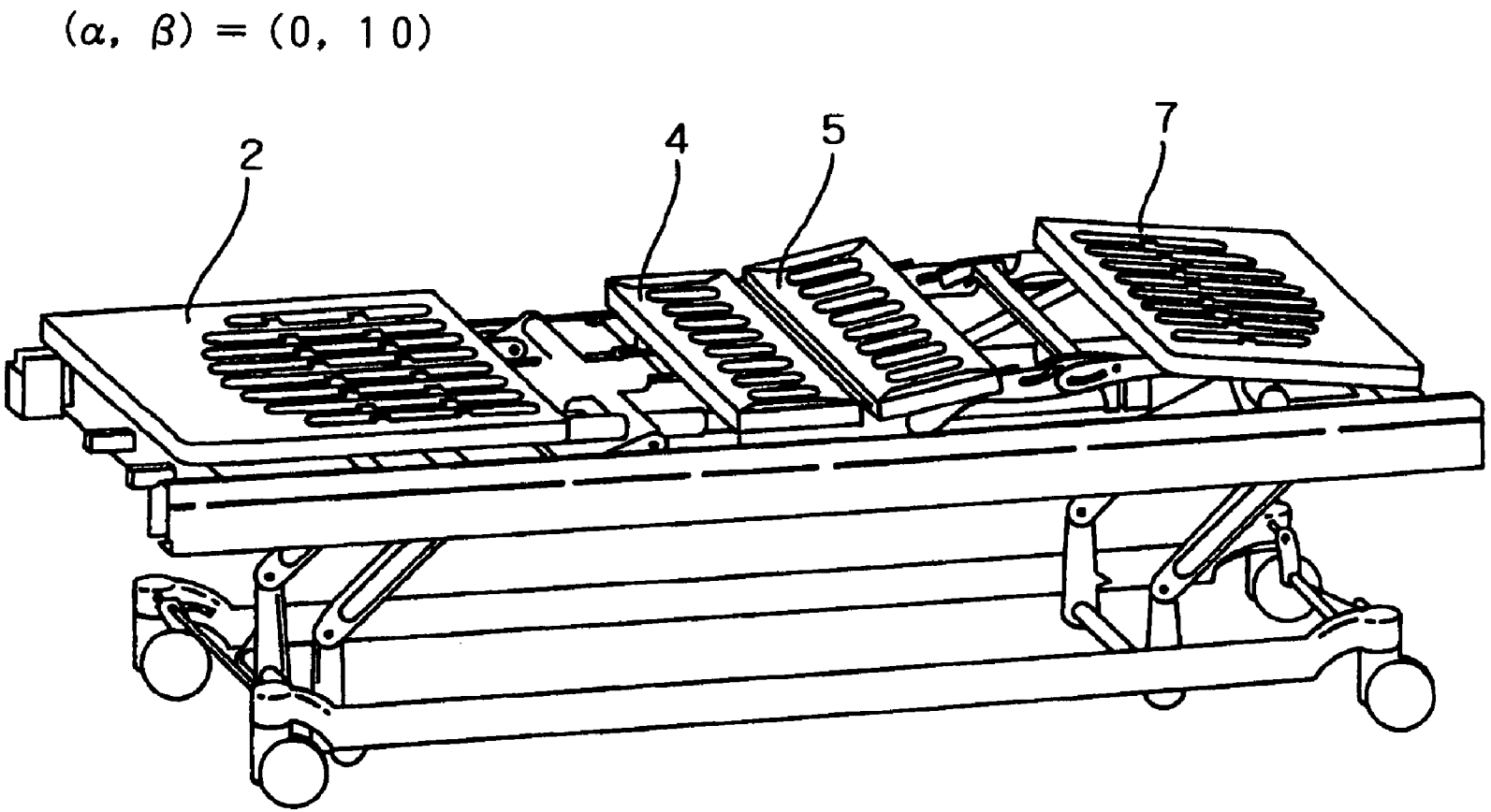
FIG. 18 is a perspective view illustrating the operation of the electric bed when the coordinates (α, β) are (0, 10)

Then, the bed is shifted from the coordinates (40, 25) to the coordinates (19, 25). As a result, only the back bottom 2 is lifted further down with the position of the knee bottom 5 unchanged, as shown in FIG. 17.

Next, the bed is shifted from the coordinates (19, 25) to the coordinates (0, 10). Consequently, the knee bottom 5 is lifted down to the knee angle β of 10° and the back bottom 2 returns to the horizontal state.

Next, the bed is shifted from the coordinates (0, 10) to the coordinates (0, 0). This causes the bed to return to the horizontal state shown in FIG. 8.

According to the embodiment, mere depression of the lift-up start switch or the lift-down start switch once (continuous depression of the switch) causes the back bottom 2 and the knee bottom 5 to move according to the optimal patterns acquired beforehand in such a way as to associate the movement of the back bottom 2 with the movement of the knee bottom 5 and avoid slipping of the body and pressure on the body. The subjective judgment by a carer (operator) does not reflect in the movement of the bed. Therefore, the bed is always moved according to the optimal patterns acquired beforehand, regardless of the subjective judgement by the carer or even when the carer is changed, so that a patient lying on the bed can surely avoid slipping on the bed in the back lift-up operation or the back lift-down operation. In both of the work of setting the upper body of the patient up and the work of laying the patient down, no pressure is applied to the patient. Further, the patient will not suffer the deviation between shift muscles and skins and blocking of the blood vessels or interruption in the circulation of the blood can be prevented from being caused by stretching of fine blood vessels extending from the muscles to the skins, which would damage the skins. As the fixed waist bottom 4 is provided in the embodiment, the waist of the patient is stable at the time the back lift-up operation and the back lift-down operation are performed.

The patterns shown in FIGS. 20 and 21 are recommended for they do not cause slipping of a patient or do not apply pressure on the patient in the back lift-up operation and the back lift-down operation.

In the back lift-up pattern shown in FIG. 20, the reason why ($\alpha$, $\beta$) is shifted to (0, 25) from (0, 0) first is that the slipping of the body is large at the beginning of the back lift-up operation (the back angle of 0° to 10°), the slipping is suppressed by lifting up the knees before setting the back up. In the period of the movement from (0, 25) to (40, 25), the back is lifted up while slipping is suppressed and there is a certain angle formed between the back bottom 2 and the knee bottom 5, so that the patient does not feel pressure applied thereon. In the period of the movement from (40, 25) to (47, 15), as the back angle $\alpha$ becomes 40°, the back bottom 2 stands up considerably and the patient starts feeling pressure applied thereon. In this respect, when the back angle $\alpha$ is increased further, the knees are lifted down not to apply pressure on the patient. In this case, the angle defined by the back bottom 2 and the knee bottom 5 does not change significantly, so that the patient does not slip on the bed.

In the period of the movement from (47, 15) to (60, 15), the knee angle $\beta$ is constant and the back angle $\alpha$ alone gets greater. Therefore, the pressure is increased slightly. In the next period of the movement from (60, 15) to (75, 0), the back is lifted up to reach the final reaching point while the knees are lifted down. Setting the knees down can relieve the pressure that has been applied in the previous period. In the embodiment, it is important to make the back angle $\alpha$ and the knee angle $\beta$ to reach the final reaching point (75, 0) simultaneously and the knee angle $\beta$ should not be made 0 at least while the back angle $\alpha$ is increasing. As lift-up of the back and lift-down of the knees are finished at the same time or lift-down of the knees is finished at least after lift-up of the back is finished, the pressure does not remain and the comfortableness after the back lift-up operation or back lift-down operation can be improved. It is therefore necessary to lift down the knees in the period of the movement from (40, 25) to (47, 15) in order to suppress the pressure applied on the body and necessary to lift up only the back in the period of the movement from (47, 15) to (60, 15) for the back and knees should be moved to the final reaching point simultaneously in the period of the movement from (60, 15) to (75, 0).

Although the final reaching point is set to (75, 0), it is preferable that the knee angle $\beta$ should be 0° at the time a patient sits at the edge of the bed (at-the-edge sitting) and is transferred onto a wheelchair. Making a patient easier to be transferred onto a wheelchair and thus increasing the chance for the patient to move within or outside a room in this manner can improve the QOL (Quality Of Life) of the patient.

To set up the upper body of a patient on the bed to reduce the body pressure applied on the back and abdominal region, it is preferable to stop the back lift-up operation when the knee angle $\beta$ is decreased to near 10°. At such an angle, the patient can take a comfortable position. It is better to set up the back to (75, 0) in this case too in order to surely shift the center of gravity of the patient to the lower body from the haunches.

In the back lift-down pattern shown in FIG. 21, in the period of the movement from (75, 0) to (64, 10), the knees are lifted up at the same time as the back is lifted down. In the initial stage of (75° to 60°) in the back lift-down operation, the weight is concentrated on the region between the haunches to the lower body, so that even when the back is lowered, the body tends to stop on the feet side, thus increasing the slipping of the body. By lifting up the knees at the same time as the back is lowered, the weight is shifted toward the upper body to suppress the body slipping. Because continuous lift-up of the knees causes the weight to shift toward the upper body excessively in the period of the movement from (64, 10) to (50, 10), the patient would have feel pressure applied on the waist. Therefore, lift-up of the knees is stopped to widen the angle between the back bottom 2 and the knee bottom 5.

Further, in the period of the movement from (50, 10) to (740, 25), after the angle between the back bottom 2 and the knee bottom 5 is widened to the level at which the patient does not feel pressure applied thereon, the knees are lifted up further to shift the weight to the back bottom 2 completely. Thereafter, in the period of the movement from (40, 25) to (19, 25), the back is lowered with the knee angle $\beta$ set constant. Because the knee angle $\beta$ reaches the maximum value in this period, the back can be lowered without slipping the body. It is to be noted however that if the knees are lowered too in this period, the weight is shifted to the lower body again, causing the body to slip, so that the knee angle $\beta$ should be set constant.

In the subsequent period of the movement from (19, 25) to (0, 10), the back angle $\alpha$ is decreased to 25°, so that the body is not pulled toward the feet even if the knees are lowered. Accordingly, while the back is lowered, lowering the knees is started. In the final period of the movement from (0, 10) to (0, 0), the body is completely settled down and the knees should be returned to the horizontal state.

In the embodiment, the back angle $\alpha$ is 75° and the knee angle $\beta$ is 0°. Depending on the purpose of the optimal patterns, $\beta_0$ should not necessarily be 0° but may be set to, for example, about 10° at which the knees are lifted up slightly. In the embodiment, the coordinate points that constitute the lift-up pattern are (0, 0), (0, 25), (40, 25), (47, 15), (60, 15) and (75, 0) and the coordinate points that constitute the lift-down pattern are (75, 0), (64, 10), (50, 10), (40, 25), (19, 25), (0, 10) and (0, 0). However, if the angles that constitute the optimal patterns differ from those values slightly, the same advantages can be acquired. That is, if each angle in the coordinate points falls within a difference of ±3°, the back lift-up operation and the back lift-down operation can be performed in the optimal condition. Therefore, the coordinate points that constitute the lift-up pattern become (0, 0), (0, 25±3), (40±3, 25±3), (47±3, 15±3), (60±3, 15±3) and (75±3, 0) and coordinate points that constitute the lift-down pattern become (75±3, 0), (64±3, 10±3), (50±3, 10±3), (40±3, 25±3), (19±3, 25±3), (0, 10±3) and (0, 0).

As described above, the optimal patterns for the back lift-up operation and the back lift-down operation are obtained and stored in the storage section 81 of the control section 61 and the back bottom 2 and the knee bottom 5 are operated based on the patterns, so that-simple depression of the start switch once (continuous depression of the switch) can allow the back bottom 2 and the knee bottom 5 to always move along the optimal patterns, irrespectively of the operator. As mentioned earlier, the optimal patterns may be stored in a ROM and set in the storage section 81 or may be stored in a RAM.

The optimal patterns, which have been obtained under specific conditions set, should be updated as needed, in accordance with a difference in the bed structure, a change in conditions or a change in purpose. For example, the patterns shown in FIGS. 20 and 21 are preferable for the bed structure illustrated in FIGS. 1 to 18. That is, in case of an electric bed having the back bottom 2, the back bending portion 3, the waist bottom 4, the knee bottom 5, the knee bending portion 6 and the foot bottom 7, the patterns shown in FIGS. 20 and 21 are preferable to prevent body slipping and pressure from being applied to the body of the patient. However, the invention can also be adapted to other various types of electric beds, such as an electric bed which does not have the back bending portion and the knee bending portion, an electric bed which does not have the waist bottom or the foot bottom or an electric bed which has a second back bottom located between the first back bottom and the waist bottom or the knee bottom and allows the second back bottom to rotate in the same direction as the first back bottom in response to the movement of the first back bottom when the first back bottom is set up. In those cases, the optimal patterns to prevent body slipping and pressure on a patient often differ from those shown in FIGS. 20 and 21 and the optimal patterns should be acquired in accordance with the structure of each bed.

In those case, when a ROM is used, new patterns can be set in the storage section 81 by replacing the ROM with a new one, and when a RAM is used, new patterns can be set in the storage section 81 by externally rewriting data in the RAM.

According to the invention, as elaborated above, when the back bottom is set up and when the back bottom is set down, the back bottom and the knee bottom can always be moved along the optimal patterns, regardless of the subjective judgement of a carer or an operator. This reliably prevents a carereceiver from slipping, regardless of subjective judgment by an operator or a carer, at the time of performing a back lift-up operation and back lift-down operation of an electric bed. It is therefore possible to prevent pressure from being applied onto the abdominal region and chest region of the carereceiver, thus relieving the carereceiver and carer of the burden.

The second embodiment of the invention will now be discussed. The second embodiment is identical to the first embodiment in the structure of the electric bed but differs from the first embodiment in the control modes of the control section 62.

Figure 23:
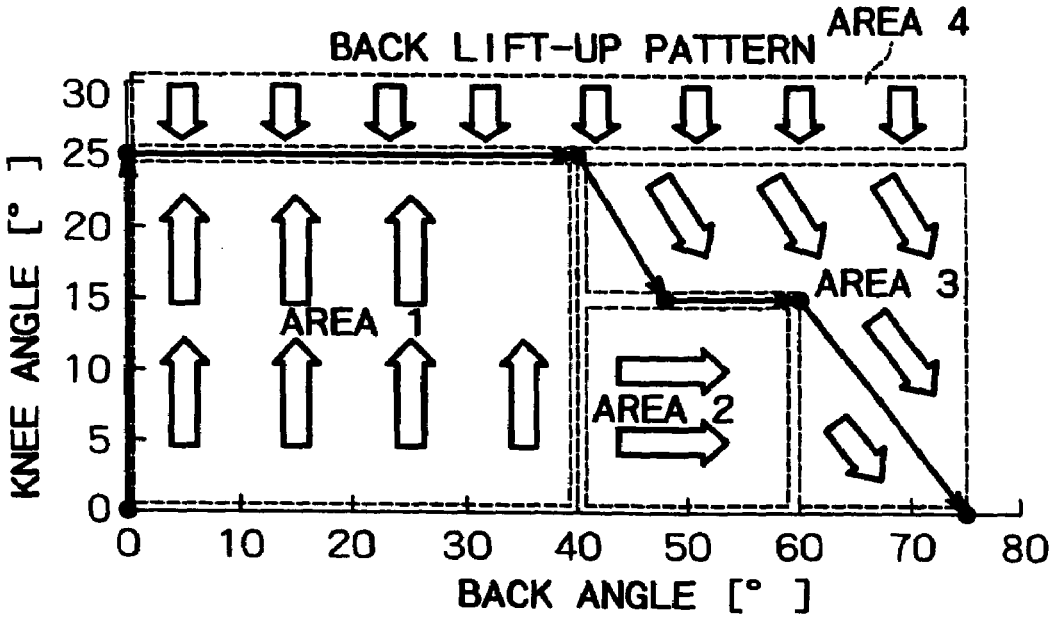
FIG. 23 is a graph showing operational modes at the time of performing the back lift-up operation.
Figure 24:
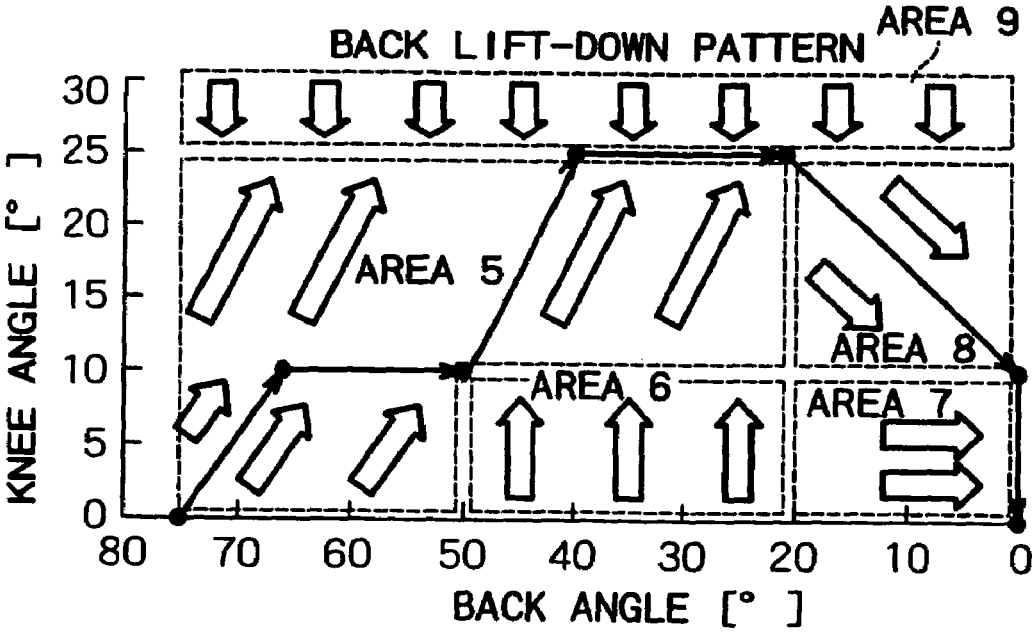
FIG. 24 is a graph showing operational modes at the time of performing the back lift-down operation.

The second embodiment is effective in the following case. There may be a case where the back bottom is lifted up or down from the state where the back bottom or the knee bottom has already been set up, not a case where the back bottom is lifted up or down according to the pattern shown in FIG. 20 or FIG. 21 from the state where the back bottom and the knee bottom 5 are in a horizontal position of (0, 0). FIGS. 23 and 24 respectively show operational modes for lifting the back up or down along the patterns shown in FIGS. 20 and 21 when the back bottom and the knee bottom are deviated from the illustrated patterns.

In the mode for the back lift-up operation shown in FIG. 23, the (α, β) coordinate system is segmented into four areas, area 1 to area 4, shown in FIG. 23 and the moving mode for the back bottom and the knee bottom are determined for each area. The moving modes for moving the back bottom and the knee bottom are determined according to the area where the back bottom (back angle α) and the knee bottom (knee angle β) lie at the time the back lift-up operation is carried out. That is, the following are the ranges and the moving modes for the individual areas.

(1) Area 1
Range: $0 \leqq \alpha \leqq 40$, $0 \leqq \beta \leqq 25$
Mode: only the knee angle β is increased with the back angle α set constant (2) Area 2
Range: $40 \leqq \alpha \leqq 60$, $0 \leqq \beta \leqq 15$
Mode: the back angle α is increased with the knee angle β set constant (3) Area 3
Range: $60 \leqq \alpha \leqq 75$, $0 \leqq \beta \leqq 15$ and $40 \leqq \alpha \leqq 75$, $15 \leqq \beta \leqq 25$
Mode: the knee angle β is decreased while the back angle α is increased (4) Area 4
Range: $25 \leqq \beta$
Mode: the knee angle β is decreased with the back angle α set constant Note that the case where the back angle α is equal to or greater than 75° does not work out in the embodiment.

In the mode for the back lift-down operation shown in FIG. 24, the (α, β) coordinate system is segmented into five areas, area 5 to area 9, shown in FIG. 24 and the moving mode for the back bottom and the knee bottom are determined for each area. The moving modes for moving the back bottom and the knee bottom are determined according to the area where the back bottom (back angle α) and the knee bottom (knee angle β) lie at the time the back lift-down operation is carried out. That is, the following are the ranges and the moving modes for the individual areas.

(5) Area 5
Range: $50 \leqq \alpha \leqq 75$, $0 \leqq \beta \leqq 25$ and $20 \leqq \alpha \leqq 50$, $10 \leqq \beta \leqq 25$
Mode: the knee angle β is increased while the back angle α is decreased (6) Area 6
Range: $20 \leqq \alpha \leqq 50$, $0 \leqq \beta \leqq 10$
Mode: the knee angle β is increased with the back angle α set constant (7) Area 7
Range: $0 \leqq \alpha \leqq 20$, $0 \leqq \beta \leqq 10$
Mode: the back angle α is increased with the knee angle β set constant (8) Area 8
Range: $0 \leqq \alpha \leqq 20$, $10 \leqq \beta \leqq 25$
Mode: the back angle α is decreased and the knee angle β is decreased too (9) Area 9

Range: $25 \leqq \beta$

Mode: the knee angle β is decreased with the back angle α set constant

Note that the case where the back angle α is equal to or greater than 75° does not work out in the embodiment and only the back bottom is lifted down through the associated operation.

The operation of the thus constituted electric bed will be discussed below. As the second embodiment differs from the first embodiment only in the control modes of the control section 62 and is the same as the first embodiment in the operations of the back lift-up unit 20 and the knee lift-up unit 40, the description of the identical operations will be omitted. In second embodiment, the back lift-up unit 20 and knee lift-up unit 40 operate interlockingly according to the modes shown in FIGS. 23 and 24 in such a way that the back angle α and the knee angle β change along the patterns shown in FIGS. 20 and 21. The flowchart that illustrates the operation of the control section 62 in this embodiment is identical to the one shown in FIG. 22.

In case where a signal instructing the initiation of the back lift-up operation is input to the control section 62 from the operation box 11, the decision in step S1 in FIG. 22 is "YES", so that the operation section 82 of the control section 62 selects the lift-up pattern shown in FIG. 20 and the operation mode shown in FIG. 23 from the storage section 81. Then, the operation section 82 reads and grasps the back angle α of the back bottom 2 and the knee angle β of the knee bottom 5 using the correlation table stored in the storage section 81 based on the detection signals from the sensors 72 and 73 that are input to the control section 62.

Then, the operation section 82 compares the current back angle α and knee angle β with the operation mode in FIG. 23 and decides an operation request for each of the actuators 28 and 47 (step S3). The operation request is a "stop request", "lift-up operation request" or "lift-down operation request" for the back bottom 2 or the knee bottom 5.

In case where the positions of the back bottom 2 and the knee bottom 5 or the back angle α and the knee angle β are located in the area 1 shown in FIG. 23 at the time the signal to instruct the back lift-up operation is input from the operation box 11, such as in case where the bed is horizontal, in case where the operator has lifted only the back bottom 2 up to a midway (e.g., α=20) through a separate manipulation, in case where the operator has lifted only the knee bottom 5 up to a midway (e.g., β=15), or in case where the operator has lifted the back bottom 2 and the knee bottom 5 up to a midway (e.g., α=20, β=15), only the knee angle β is increased while keeping the back angle α constant. Accordingly, the back angle α and the knee angle β reach the boundary between the area 1 and the area 4 and are changed thereafter according to the reference pattern indicated by lines in the diagram. That is, the operation section 82 outputs the "stop request" for the back bottom 2 or the knee bottom 5 in case of setting the back angle α or the knee angle β constant, outputs the "lift-up operation request" for the back bottom 2 or the knee bottom 5 in case of increasing the back angle α or the knee angle β, and outputs the "lift-down operation request" for the back bottom 2 or the knee bottom 5 in case of decreasing the back angle α or the knee angle β constant.

The same is true of the case where the back angle α and the knee angle β are located in the other areas 2 to 4 shown in FIG. 23 at the time the signal to instruct the back lift-up operation is input from the operation box 11. In case where the back angle α and the knee angle β are located in the area 2, the back angle α alone is increased while keeping the knee angle β constant. After the back angle α and the knee angle β are moved to the area 3 from the area 2, the back angle α is increased but the knee angle β is decreased as will be discussed later. As a result, the back angle α keeps increasing until the knee angle β becomes 0°. In case where the back angle α and the knee angle β are located in the area 3, the back angle α is increased but the knee angle β is decreased. When the back angle α and the knee angle β reach the boundary between the area 2 and the area 3, therefore, the back angle α and the knee angle β are moved according to the reference pattern indicated by the lines in FIG. 23. In case where the operation is started from the area 3 and the back angle α and the knee angle β do not reach the boundary between the area 3 and the area 2 as the back angle α is increased while the knee angle β is reduced, the knee angle β is kept reduced until the back angle α is increased to 75°. In the area 3, the ratio of the increasing rate of the back angle α to the decreasing rate of the knee angle β is the same as the ratio when (α, β) changes from (40, 25) to (47, 15) or the ratio when (α, β) changes from (60, 15) to (75, 0) in the reference pattern. In case where the back angle α and the knee angle β are located in the area 4 at the time the back lift-up operation start signal is input, the back angle α is constant and only the knee angle β is decreased. When the back angle α and the knee angle β reach the boundary between the area 4 and the area 1, the back angle α and the knee angle β move according to the reference pattern, or when the back angle α and the knee angle β reach the boundary between the area 4 and the area 3, the back angle α and the knee angle β move in the same way as they do in the case where the operation is started from within the area 3.

In case where the start signal transferred from the operation box 11 indicates the initiation of the back lift-down operation, the decision in step S1 in FIG. 22 is "NO", so that the flow proceeds to step S2. In this step S2, because of the start signal instructing the back lift-down operation, the decision is "YES" and the operation section 82 selects the back lift-down pattern shown in FIG. 21 and the operation mode in FIG. 24 from the storage section 81. The operation section 82 grasps the back angle α and the knee angle β in the same manner as mentioned in the previous case, compares the back angle α and the knee angle β with the operation mode in FIG. 24 and decides an operation request for each of the actuators 28 and 47 (step S4). The operation request is the "stop request", "lift-up operation request" or "lift-down operation request" for the back bottom 2 or the knee bottom 5.

In case where the positions of the back bottom 2 and the knee bottom 5 or the back angle α and the knee angle β are located in the area 5 shown in FIG. 24 at the time the signal to instruct the back lift-up operation is input from the operation box 11, such as in case where the bed is in the desired back lift-up position of (α, β) (75, 0), in case where the operator has lifted only the back bottom 2 up to a midway (e.g., α=60) through a separate manipulation, in case where the operator has lifted only the knee bottom 5 up to a midway (e.g., β=5), or in case where the operator has moved the back bottom 2 and the knee bottom 5 to a midway (e.g., α=60, β=5), the knee angle β is increased while decreasing the back angle α. Accordingly, when the back angle α and the knee angle β reach the boundary between the area 5 and the area 6, the back angle α remains constant and the knee angle β is increased thereafter. When the back bottom 2 and the knee bottom 5 starts from the area 5 and reach the boundary between the area 5 and the area 9, the knee angle β remains at 25° and the back angle α is reduced, after which the back angle α and the knee angle β are shifted according to the reference pattern shown in FIG. 24. In case where the back angle α and the knee angle β lie in the area 8, the back angle α and the knee angle β are both decreased. In case where the back angle α and the knee angle β lie in the area 7, the back angle α is decreased while setting the knee angle β constant. Then, when the back angle α reaches 0°, the knee angle β is reduced to 0°. In case where the back angle α and the knee angle β are located in the area 9 at the time the back lift-down operation start signal is input, the knee angle β is decreased to be shifted to the area 5 or the area 8, after which the back angle α and the knee angle β are moved in the manner discussed above. That is, the operation section 82 outputs the "stop request" for the back bottom 2 or the knee bottom 5 in case of setting the back angle α or the knee angle β constant, outputs the "lift-up operation request" for the back bottom 2 or the knee bottom 5 in case of increasing the back angle α or the knee angle β, and outputs the "lift-down operation request" for the back bottom 2 or the knee bottom 5 in case of decreasing the back angle α or the knee angle β constant.

In case where the signal input to the control section 62 from the operation box 11 via the input section 61 indicates neither the initiation of the back lift-up operation nor the initiation of the back lift-down operation, the operation section 82 decides that the operation requests for both the back bottom 2 and the knee bottom 5 are the "stop request" (step S5).

In case where the operation request for the back bottom 2 is the "stop request" in step S6 in FIG. 22, the operation section 82 sends a control signal to the relay 66 of the actuator for the back bottom 2 to stop the motor 69 (step S8). In case where the operation request for the back bottom 2 is not the "stop request", the operation section 82 determines in step S7 whether or not the operation request for the back bottom 2 is the "lift-up operation request", and outputs a control signal to the relay 66 to rotate the motor 69 in the direction of increasing the back angle α of the back bottom 2 in case of the "lift-up operation request" ("YES") (step S9). In case of the "lift-down operation request" ("NO"), the operation section 82 outputs a control signal to the relay 66 to rotate the motor 69 in the direction of decreasing the back angle α of the back bottom 2 (step S10).

In case where the operation request for the knee bottom 5 is the "stop request" in step S11 in FIG. 22, the operation section 82 sends a control signal to the relay 67 of the actuator for the knee bottom 5 to stop the motor 70 (step S13). In case where the operation request for the knee bottom 5 is not the "stop request", the operation section 82 determines in step S12 whether or not the operation request for the knee bottom 5 is the "lift-up operation request", and outputs a control signal to the relay 67 to rotate the motor 70 in the direction of increasing the knee angle β of the knee bottom 5 in case of the "lift-up operation request" ("YES") (step S14). In case of the "lift-down operation request" ("NO"), the operation section 82 outputs a control signal to the relay 67 to rotate the motor 70 in the direction of decreasing the knee angle β of the knee bottom 5 (step S15).

Then, as the flow returns to step S1 again and is repeated at the adequate intervals, the back bottom 2 and the knee bottom 5 are lifted up or down along the pattern shown in FIG. 20 or FIG. 21. Because the flow returns to step S1 and step S2 after step S15 to determine whether the back lift-up switch is on or off and to determine whether the back lift-down switch is on or off, the lift-up operation takes place as long as the lift-up switch is always on or the lift-down operation takes place as long as the lift-down switch is always on. In case where the lift-up switch or the lift-down switch is switched off, the operation request always becomes "stop" in step S5 and all the operations stop. To continuously carry out the lift-up operation, therefore, the operator should normally set the lift-up switch on and should normally keep depressing the switch if it is a push button. In case where the lift-up switch and the lift-down switch are switched on simultaneously, the operation is normally stopped, though such is not illustrated in the flowchart in FIG. 22. Setting the switching actions in the above-described manner improves the safety.

According to the second embodiment too, mere depression of the lift-up start switch or the lift-down start switch once (continuous depression of the switch) causes the back bottom 2 and the knee bottom 5 to move according to the optimal patterns acquired beforehand in such a way as to associate the movement of the back bottom 2 with the movement of the knee bottom 5 and avoid positional deviation and oppressive feeling. The subjective judgment by a carer (operator) does not reflect in the movement of the bed. Therefore, the bed is always moved according to the optimal patterns acquired beforehand, regardless of the subjective judgement by the carer or even when the carer is changed, so that a patient lying on the bed can surely avoid slipping on the bed in the back lift-up operation or the back lift-down operation. In both of the work of setting the upper body of the patient up and the work of laying the patient down, no oppressive feeling is applied to the patient. Further, the patient will not suffer the deviation between shift muscles and skins and blocking of the blood vessels or interruption in the circulation of the blood can be prevented from being caused by stretching of fine blood vessels extending from the muscles to the skins, which would damage the skins. As the fixed waist bottom 4 is provided in the embodiment, the waist of the patient is stable at the time the back lift-up operation and the back lift-down operation are performed.

What is claimed is:

1. An electric bed comprising:

a back bottom;

a knee bottom;

a first drive section for rocking said back bottom up and down;

a second drive section for rocking said knee bottom up and down; and a control section which controls said first drive section and said second drive section in such a way that a back angle α that is a lift-up angle of said back bottom from a horizontal state and a knee angle β that is a lift-up angle of said knee bottom from a horizontal state change along a preset pattern defined in a coordinate system (α, β), and which has a storage section for storing a pattern connecting between a coordinate point (0, 0) at which each of said back bottom and said knee bottom is horizontal and a coordinate point ($\alpha_0$, $\beta_0$) at which said back bottom is lifted up in (α, β) coordinates by a plurality of predefined (α, β) coordinate points and an operation section for controlling said first drive section and said second drive section in such a way that said back angle α and said knee angle β change along said pattern, wherein said pattern comprises at least said coordinate point ($\alpha_0$, $\beta_0$).

2. The electric bed according to claim 1, wherein as said pattern, a lift-up pattern for lifting said back bottom up from said horizontal state and a lift-down pattern for lifting said back bottom down to said horizontal state from a lifted-up state are provided separately.

3. The electric bed according to claim 2, further comprising an operation box for selecting either a back lift-up operation for lifting said back bottom up from said horizontal state and a back lift-down operation for lifting said back bottom down to said horizontal state and inputting a start signal for starting an operation of said control section, and wherein in case where said start signal instructs initiation of said back lift-up operation, said operation section compares said lift-up pattern with said back angle $\alpha$ and said knee angle $\beta$, outputs a stop request when said back angle $\alpha$ or said knee angle $\beta$ matches with said lift-up pattern, outputs a lift-up operation request when said back angle $\alpha$ or said knee angle $\beta$ is smaller than a value designated by said lift-up pattern and outputs a lift-down operation request when said back angle $\alpha$ or said knee angle $\beta$ is greater than said value designated by said lift-up pattern, and in case where said start signal instructs initiation of said back lift-down operation, said operation section compares said lift-down pattern with said back angle $\alpha$ and said knee angle $\beta$, outputs said stop request when said back angle $\alpha$ or said knee angle $\beta$ matches with said lift-down pattern, outputs said lift-up operation request when said back angle $\alpha$ or said knee angle $\beta$ is smaller than a value designated by said lift-down pattern and outputs said lift-down operation request when said back angle $\alpha$ or said knee angle $\beta$ is greater than said value designated by said lift-down pattern.

4. The electric bed according to claim 3, wherein said operation box has a first switch for commanding initiation of said back lift-up operation and a second switch for commanding initiation of said back lift-down operation, and said operation section determines that initiation of said back lift-up operation has been instructed when said first switch is set on, determines that initiation of said back lift-down operation has been instructed when said first switch is set off and said second switch is set on, and outputs said stop request when both of said first switch and said second switch are off.

5. The electric bed according to claim 2, further comprising a back bending portion for coupling said back bottom to said knee bottom in a bendable manner, and wherein said back angle $\alpha$ is 75°, said knee angle $\beta$ is 0°, coordinate points which constitute said lift-up pattern are (0, 0), (0, 25±3), (40±3, 25±3), (47±3, 15±3), (60±3, 15±3) and (75±3, 0) and coordinate paints which constitute said lift-down pattern are (75±3, 0), (64±3, 10±3), (50±3, 10±3), (40±3, 25±3), (19±3, 25±3), (0, 10±3) and (0, 0).

6. The electric bed according to claim 5, wherein a fixed waist bottom is coupled between said back bending portion and said knee bottom, a foot bottom is coupled to an opposite side of said knee bottom to said back bottom via a bendable knee bending portion, and said foot bottom is coupled to said knee bottom by a link mechanism and moves in response to movement of said knee bottom.

7. The bed of claim 1, wherein said pattern comprises said plurality of points.

8. A control method for an electric bed comprising a back bottom, a knee bottom, a first drive section for rocking said back bottom up and down and a second drive section for rocking said knee bottom up and down, said control method comprising:

presetting, in a control section, a pattern connecting between a coordinate point (0, 0) at which each of said back bottom and said knee bottom is horizontal and a coordinate point ($\alpha_0$, $\beta_0$) at which said back bottom is lifted up in ($\alpha$, $\beta$) coordinates by a plurality of points, said ($\alpha$, $\beta$) coordinates being defined by a back angle $\alpha$ that is a lift-up angle of said back bottom from a horizontal state and a knee angle $\beta$ that is a lift-up angle of said knee bottom from a horizontal state change along a preset pattern; and driving said first drive section and said second drive section in such a way that said back angle $\alpha$ and said knee angle $\beta$ change along said pattern, wherein said pattern comprises at least said coordinate point ($\alpha_0$, $\beta_0$).

9. The control method according to claim 8, wherein as said pattern, a lift-up pattern for lifting said back bottom up from said horizontal state and a lift-down pattern for lifting said back bottom down to said horizontal state from a lifted-up state are provided separately.

10. The control method according to claim 9, wherein in case where initiation of a back lift-up operation for lifting said back bottom up from said horizontal state is instructed, said lift-up pattern is compared with said back angle $\alpha$ and said knee angle $\beta$, a stop request is output when said back angle $\alpha$ or said knee angle $\beta$ matches with said lift-up pattern, a lift-up operation request is output when said back angle $\alpha$ or said knee angle $\beta$ is smaller than a value designated by said lift-up pattern and a lift-down operation request is output when said back angle $\alpha$ or said knee angle $\beta$ is greater than said value designated by said lift-up pattern, and in case where initiation of a back lift-down operation for lifting said back bottom down to said horizontal state is instructed, said lift-down pattern is compared with said back angle $\alpha$ and said knee angle $\beta$, said stop request is output when said back angle $\alpha$ or said knee angle $\beta$ matches with said lift-down pattern, said lift-up operation request is output when said back angle $\alpha$ or said knee angle $\beta$ is smaller than a value designated by said lift-down pattern and said lift-down operation request is output when said back angle $\alpha$ or said knee angle $\beta$ is greater than said value designated by said lift-down pattern.

11. The control method according to claim 9, wherein said back bottom is coupled to said knee bottom in a bendable manner by a back bending portion, and said back angle $\alpha$ is 75°, said knee angle $\beta$ is 0°, coordinate points which constitute said lift-up pattern are (0, 0), (0, 25±3), (40±3, 25±3), (47±3, 15±3), (60±3, 15±3) and (75±3, 0) and coordinate points which constitute said lift-down pattern are (75±3, 0), (64±3, 10±3), (50±3, 10±3), (40±3, 25±3), (19±3, 25±3), (0, 10±3) and (0, 0).

12. The control method according to claim 11, wherein a fixed waist bottom is coupled between said back bending portion and said knee bottom, a foot bottom is coupled to an opposite side of said knee bottom to said back bottom via a bendable knee bending portion, and said foot bottom is coupled to said knee bottom by a link mechanism and moves in response to movement of said knee bottom.

13. The method of claim 8, wherein said pattern comprises said plurality of points.

14. A control apparatus for controlling an electric bed comprising a back bottom, a knee bottom, a first drive section for racking said back bottom up and down and a second drive section for rocking said knee bottom up and down, said control apparatus comprising:

a storage section for storing a pattern connecting between a coordinate point (0, 0) at which each of said back bottom and said knee bottom is horizontal and a coordinate point ($\alpha_0$, $\beta_0$) at which said back bottom is lifted up in ($\alpha$, $\beta$) coordinates by a plurality of points, said ($\alpha$, $\beta$) coordinates being defined by a back angle $\alpha$ that is a lift-up angle of said back bottom from a horizontal state and a knee angle β that is a lift-up angle of said knee bottom from a horizontal state change along a preset pattern; and an operation section for controlling said first drive section and said second drive section in such a way that said back angle α and said knee angle β change along said pattern, wherein said pattern comprises at least said coordinate point ($\alpha_0$, $\beta_0$).

15. The control apparatus according to claim 14, wherein as said pattern, a lift-up pattern for lifting said back bottom up from said horizontal state and a lift-down pattern for lifting said back bottom down to said horizontal state from a lifted-up state are provided separately.

16. The control apparatus according to claim 15, further comprising an operation box for selecting either a back lift-up operation for lifting said back bottom up from said horizontal state and a back lift-down operation for lifting said back bottom down to said horizontal state and inputting a start signal for starting an operation of said control section, and wherein in case where said start signal instructs initiation of said back lift-up operation, said operation section compares said lift-up pattern with said back angle α and said knee angle β, outputs a stop request when said back angle α or said knee angle β matches with said lift-up pattern, outputs a lift-up operation request when said back angle α or said knee angle β is smaller than a value designated by said lift-up pattern and outputs a lift-down operation request when said back angle α or said knee angle β is greater than said value designated by said lift-up pattern, and in case where said start signal instructs initiation of said back lift-down operation, said operation section compares said lift-down pattern with said back angle α and said knee angle β, outputs said stop request when said back angle α or said knee angle β matches with said lift-down pattern, outputs said lift-up operation request when said back angle α or said knee angle β is smaller than a value designated by said lift-down pattern and outputs said lift-down operation request when said back angle α or said knee angle β is greater than said value designated by said lift-down pattern.

17. The control apparatus according to claim 16, wherein said operation box has a first switch for commanding initiation of said back lift-up operation and a second switch for commanding initiation of said back lift-down operation, and said operation section determines that initiation of said back lift-up operation has been instructed when said first switch is set on, determines that initiation of said back lift-down operation has been instructed when said first switch is set off and said second switch is set on, and outputs said stop request when both of said first switch and said second switch are off.

18. The control apparatus according to claim 15, wherein said back bottom is coupled to said knee bottom in a bendable manner by a back bending portion, and said back angle α is 75°, said knee angle β is 0°, coordinate points which constitute said lift-up pattern are (0, 0), (0, 25±3), (40±3, 25±3), (47±3, 15±3), (60±3, 15±3) and (75±3, 0) and coordinate points which constitute said lift-down pattern are (75±3, 0), (64±3, 10±3), (50±3, 10±3), (40±3, 25±3), (19±3, 25±3), (0, 10±3) and (0, 0).

19. The control apparatus according to claim 18, wherein a fixed waist bottom is coupled between said back bending portion and said knee bottom, a foot bottom is coupled to an opposite side of said knee bottom to said back bottom via a bendable knee bending portion, and said foot bottom is coupled to said knee bottom by a link mechanism and moves in response to movement of said knee bottom.

20. The apparatus of claim 14, wherein said pattern comprises said plurality of points.

21. An electric bed comprising:

a back bottom;

a knee bottom;

a first drive section for rocking said back bottom up and down;

a second drive section for rocking said knee bottom up and down; and a control section which controls said first drive section and said second drive section in such a way that a back angle α that is a lift-up angle of said back bottom from a horizontal state and a knee angle β that is a lift-up angle of said knee bottom from a horizontal state change along a preset pattern, and which has a storage section for segmenting (α, β) coordinates into a plurality of areas by taking, as a reference, a pattern connecting between a coordinate point (0, 0) at which each of said back bottom and said knee bottom is horizontal and a coordinate point ($\alpha_0$, $\beta_0$) at which said back bottom is lifted up in said (α, β) coordinates by a plurality of points and storing operational modes of said back bottom and said knee bottom for each area, and an operation section for determining in which one of said areas said back bottom and said knee bottom are located and controlling said first drive section and said second drive section based on said operational modes of that determined area.

22. The electric bed according to claim 21, wherein as said pattern, a lift-up pattern for lifting said back bottom up from said horizontal state and a lift-down pattern for lifting said back bottom down to said horizontal state from a lifted-up state are provided separately.

23. The electric bed according to claim 22, further comprising an operation box for selecting either a back lift-up operation for lifting said back bottom up from said horizontal state and a back lift-down operation for lifting said back bottom down to said horizontal state and inputting a start signal for starting an operation of said control section, and wherein said operation box has a first switch for commanding initiation of said back lift-up operation and a second switch for commanding initiation of said back lift-down operation, and said operation section determines that initiation of said back lift-up operation has been instructed when said first switch is set on, determines that initiation of said back lift-down operation has been instructed when said first switch is set off and said second switch is set on, and outputs said stop request when both of said first switch and said second switch are off.

24. The electric bed according to claim 22, further comprising a back bending portion for coupling said back bottom to said knee bottom in a bendable manner, and wherein said back angle α is 75°, said knee angle β is 0°, coordinate points which constitute said lift-up pattern are (0, 0), (0, 25±3), (40±3, 25±3), (47±3, 15±3), (60±3, 15±3) and (75±3, 0) and coordinate points which constitute said lift-down pattern are (75±3, 0), (64±3, 10±3), (50±3, 10±3), (40±3, 25±3), (19±3, 25±3), (0, 10±3) and (0, 0).

25. The electric bed according to claim 24, wherein a fixed waist bottom is coupled between said back bending portion and said knee bottom, a foot bottom is coupled to an opposite side of said knee bottom to said back bottom via a bendable knee bending portion, and said foot bottom is coupled to said knee bottom by a link mechanism and moves in response to movement of said knee bottom.

26. The bed of claim 21, wherein said pattern comprises at least said coordinate point ($\alpha_0$, $\beta_0$).

27. A control method for an electric bed comprising a back bottom, a knee bottom, a first drive section for rocking said back bottom up and down and a second drive section far rocking said knee bottom up and down, said control method comprising:

segmenting ($\alpha$, $\beta$) coordinates, defined by a back angle $\alpha$ that is a lift-up angle of said back bottom from a horizontal state and a knee angle $\beta$ that is a lift-up angle of said knee bottom from a horizontal state change along a preset pattern, into a plurality of areas by taking, as a reference, a pattern connecting between a coordinate point (0, 0) at which each of said back bottom and said knee bottom is horizontal and a coordinate point ($\alpha_0$, $\beta_0$) at which said back bottom is lifted up in said ($\alpha$, $\beta$) coordinates by a plurality of points;

presetting operational modes of said back bottom and said knee bottom in a control section for each area;

determining in which one of said areas said back bottom and said knee bottom are located; and controlling said first drive section and said second drive section based on said operational modes of that determined area.

28. The control method according to claim 27, wherein as said pattern, a lift-up pattern for lifting said back bottom up from said horizontal state and a lift-down pattern for lifting said back bottom down to said horizontal state from a lifted-up state are provided separately.

29. The control method according to claim 28, wherein said back bottom is coupled to said knee bottom in a bendable manner by a back bending portion, and said back angle $\alpha$ is 75°, said knee angle $\beta$ is 0°, coordinate points which constitute said lift-up pattern are (0, 0), (0, 25±3), (40±3, 25±3), (47±3, 15±3), (60±3, 15±3) and (75±3, 0) and coordinate points which constitute said lift-down pattern are (75±3, 0), (64±3, 10±3), (50±3, 10±3), (40±3, 25±3), (19±3, 25±3), (0, 10±3) and (0, 0).

30. The control method according to claim 29, wherein a fixed waist bottom is coupled between said back bending portion and said knee bottom, a foot bottom is coupled to an opposite side of said knee bottom to said back bottom via a bendable knee bending portion, and said foot bottom is coupled to said knee bottom by a link mechanism and moves in response to movement of said knee bottom.

31. The method of claim 27, wherein said pattern comprises at least said coordinate point ($\alpha_0$, $\beta_0$).

32. A control apparatus for controlling an electric bed comprising a back bottom, a knee bottom, a first drive section for rocking said back bottom up and down and a second drive section for rocking said knee bottom up and down, said control apparatus comprising:

a storage section for segmenting ($\alpha$, $\beta$) coordinates, defined by a back angle $\alpha$ that is a lift-up angle of said back bottom from a horizontal state and a knee angle $\beta$ that is a lift-up angle of said knee bottom from a horizontal state change along a preset pattern, into a plurality of areas by taking, as a reference, a pattern connecting between a coordinate point (0, 0) at which each of said back bottom and said knee bottom is horizontal and a coordinate point ($\alpha_0$, $\beta_0$) at which said back bottom is lifted up in said ($\alpha$, $\beta$) coordinates by a plurality of points, and storing operational modes of said back bottom and said knee bottom in a control section for each area; and an operation section for determining in which one of said areas said back bottom and said knee bottom are located, and controlling said first drive section and said second drive section based on said operational modes of that determined area.

33. The control apparatus according to claim 32, wherein as said pattern, a lift-up pattern for lifting said back bottom up from said horizontal state and a lift-down pattern for lifting said back bottom down to said horizontal state from a lifted-up state are provided separately.

34. The control apparatus according to claim 33, further comprising an operation box for selecting either a back lift-up operation for lifting said back bottom up from said horizontal state and a back lift-down operation for lifting said back bottom down to said horizontal state and inputting a start signal for starting an operation of said control section, and wherein said operation box has a first switch for commanding initiation of said back lift-up operation and a second switch for commanding initiation of said back lift-down operation, and said operation section determines that initiation of said back lift-up operation has been instructed when said first switch is set on, determines that initiation of said back lift-down operation has been instructed when said first switch is set off and said second switch is set on, and outputs said stop request when both of said first switch and said second switch are off.

35. The control apparatus according to claim 34, wherein said back bottom is coupled to said knee bottom in a bendable manner by a back bending portion, and said back angle $\alpha$ is 75 degrees, said knee angle $\beta$ is zero degrees, coordinate points which constitute said back lift-up operation are (0, 0), (0, 25±3), (40±3, 25±3), (47±3, 15±3), (60±3, 15±3), and (75±3, 0), and coordinate points which constitute said back lift-down operation are (75±3, 0), (64±3, 10±3), (50±3, 10±3), (40±3, 25±3), (19±3, 25±3), (0, 10±3), and (0, 0).

36. The control apparatus according to claim 35, wherein a fixed waist bottom is coupled between said back bending portion and said knee bottom, a foot bottom is coupled to an opposite side of said knee bottom to said back bottom via a bendable knee bending portion, and said foot bottom is coupled to said knee bottom by a link mechanism and moves in response to movement of said knee bottom.

37. The apparatus of claim 32, wherein said pattern comprises at least said coordinate point ($\alpha_0$, $\beta_0$).

38. An electric bed comprising:

a back;

a knee;

a controller that controls the angle $\alpha$ of the back from the horizontal and the angle $\beta$ of the knee from the horizontal so that the angles $\alpha$ and $\beta$ follow a preset pattern defined in a coordinate system ($\alpha$, $\beta$); and a storage that stores the preset pattern which connects between a coordinate point (0, 0) at which each of said back and said knee is horizontal and a coordinate point ($\beta_0$, $\beta_0$) at which said back is lifted up in ($\alpha$, $\beta$) coordinates by a plurality of predefined ($\alpha$, $\beta$) coordinate points.

39. The bed of claim 38, further comprising:

a first driver for rotating said back; and a second driver for rotating said knee, wherein said controller controls the angles $\alpha$ and $\beta$ by controlling said first driver and said second driver.

40. The bed of claim 38, wherein said pattern reduces the slipping of a patient on the bed.

41. The bed of claim 38, wherein said pattern reduces pressure to at least one of an abdominal and chest region of a patient on the bed.

42. The bed of claim 38, wherein said pattern comprises a coordinate point of (0, 25±3).

43. The bed of claim 38, wherein said pattern comprises a coordinate point of (40±3, 25±3).

44. The bed of claim 38, wherein said pattern comprises a coordinate point of (47±3, 15±3).

45. The bed of claim 38, wherein said pattern comprises a coordinate point of (60±3, 15±3).

46. The bed of claim 38, wherein said pattern comprises a coordinate point of (75±3, 0).

47. The bed of claim 38, wherein said pattern comprises a coordinate point of (64±3, 10±3).

48. The bed of claim 38, wherein said pattern comprises a coordinate point of (50±3, 10±3).

49. The bed of claim 38, wherein said pattern comprises a coordinate point of (19±3, 25±3).

50. The bed of claim 38, wherein said pattern comprises a coordinate point of (0, 10±3).

51. An electric bed comprising:

a back;

a knee;

a controller that controls the angle $\alpha$ of the back from the horizontal and the angle $\beta$ of the knee from the horizontal so that the angles $\alpha$ and $\beta$ follow a segmented preset pattern; and a storage that stores the segmented preset pattern, wherein the segmented preset pattern is segmented into a plurality of areas of said angles $\alpha$ and $\beta$ and wherein the storage also stores operational modes of said back and said knee for each of the plurality of areas.

52. The bed of claim 51, wherein each of said operational modes determines how said controller controls the angles $\alpha$ and $\beta$.

53. The bed of claim 51, wherein said segmented preset pattern connects at least a coordinate point (0, 0) and a coordinate point ($\alpha_0$, $\beta_0$) and defines at least one boundary of at least one of said plurality of areas.

* * * * *